US005799131A

United States Patent [19]

Taniguchi et al.

[11] Patent Number: 5,799,131

[45] Date of Patent: Aug. 25, 1998

[54] SPEECH CODING AND DECODING SYSTEM

[75] Inventors: Tomohiko Taniguchi, Yokohama, Japan; Mark Johnson, Cambridge, Mass.

[73] Assignee: Fujitsu Limited, Kawasaki, Japan

[21] Appl. No.: 811,451

[22] Filed: Mar. 3, 1997

Related U.S. Application Data

[63] Continuation of Ser. No. 574,782, Dec. 19, 1995, abandoned, which is a continuation of Ser. No. 357,777, Dec. 16, 1994, abandoned, which is a continuation of Ser. No. 180,499, Jan. 12, 1994, abandoned, which is a continuation of Ser. No. 716,865, Jun. 18, 1991, abandoned.

[30] Foreign Application Priority Data

Jun. 18, 1990 [JP] Japan ..... 2-161041

[51] Int. Cl.[6] ..... G10L 9/16

[52] U.S. Cl. ..... 395/2.13; 395/2.15; 395/2.31; 395/2.32

[58] Field of Search ..... 395/2.13, 2.15, 395/2.31, 2.32

[56] References Cited

U.S. PATENT DOCUMENTS

| | | | |
|---|---|---|---|
| 4,821,324 | 4/1989 | Ozawa et al. | 395/2 |
| 4,896,361 | 1/1990 | Gerson | 395/2 |
| 4,899,385 | 2/1990 | Ketchum et al. | 395/2 |

FOREIGN PATENT DOCUMENTS

WO-A-9 101 545 2/1991 WIPO .

OTHER PUBLICATIONS

Dymarski et al., "Optimal and sub–optimal algorithms for selecting the excitation in linear predictive coders", *ICASSP 90*, pp. 485–488, Apr., vol. 1, 1990.

Proceedings, ICASSP 90, 1990 International Conference on Acoustics, Speech, and Signal Processing Apr. 3–6, 1990, IEEE Signal Processing Society, pp. 461 to 464.

*Primary Examiner*—Allen R. MacDonald
*Assistant Examiner*—Vijay Chawan
*Attorney, Agent, or Firm*—Staas & Halsey

[57] ABSTRACT

A speech coding and decoding system, where the system is operated under a known code-excited linear prediction (CELP) coding method. The CELP coding is achieved by selecting an optimum pitch prediction residual vector P from an adaptive codebook and the corresponding first gain, and at the same time, selecting an optimum code vector C from a white-noise stochastic codebook and the corresponding second gain. The system of the present invention is implemented by a weighted orthogonalization transforming unit introduced therein. The perceptually weighted code vector AC is not used as in the prior art. Rather, the weighted orthogonalization transformation unit transforms the code vector into a perceptually weighted reproduced code vector AC' being made orthogonal to the optimum perceptually weighted pitch prediction vector AP.

5 Claims, 25 Drawing Sheets

$$AP = \begin{pmatrix} b_1 \\ b_2 \\ \vdots \\ b_N \end{pmatrix}$$

$$(AP)_{TR} = \begin{pmatrix} b_N \\ \vdots \\ b_2 \\ b_1 \end{pmatrix}$$

$$A\,(AP)_{TR} = \begin{pmatrix} d_N \\ \vdots \\ d_2 \\ d_1 \end{pmatrix}$$

$$W = \begin{pmatrix} d_1 \\ d_2 \\ \vdots \\ d_N \end{pmatrix} = {}^tAAP$$

Fig. 16A $$ {}^{t}A = \begin{pmatrix} a_1 & a_2 & \cdots & a_N \\ 0 & a_1 & \cdots & a_{N-1} \\ \cdots & & \cdots & \cdots \\ 0 & 0 & \cdots & a_1 \end{pmatrix} $$

Fig. 16B $$ AP = \begin{pmatrix} b_1 \\ b_2 \\ \vdots \\ b_N \end{pmatrix} $$

Fig. 16C $$ {}^{t}AAP = \begin{pmatrix} a_1 * b_1 + a_2 * b_2 + \cdots + a_N * b_N \\ a_1 * b_2 + \cdots + a_{N-1} * b_N \\ \cdots \quad \cdots \\ a_1 * b_N \end{pmatrix} $$

INPUT SPEECH SIGNAL
A(z)/A'(z)
AX
AY
10
EVALUATION UNIT
AP
b
OPTIMUM AP
24C
W =1/|AP|²
20
AP
wAP
24d
AC'
g
AX
E
11
EVALUATION UNIT
A
23
P
C
1
ADAPTIVE CODEBOOK (PITCH PERIOD)
2
STOCHASTIC CODEBOOK (WHITE NOISE)

INPUT SPEECH SIGNAL
7
A(z)
A'(z)
AX
E
11
EVALUATION UNIT
g
AC'
23
A
C'
25
B
BB
2
V
D
C
STOCHASTIC CODEBOOK (WHITE NOISE)
2
AY
AX
10
EVALUATION UNIT
b
AP
A
P
OPTIMUM AP
21
21a
21b
21c
1
A'(z)
ADAPTIVE CODEBOOK (PITCH PERIODE)
1

SPEECH CODING AND DECODING SYSTEM

This application is a continuation of application No. 08/574,782, filed Dec. 19, 1995, now abandoned, which is a continuation of application No. 08/357,777, filed Dec. 16, 1994, now abandoned, which is a continuation of application No. 08/180,499, filed Jan. 12, 1994, now abandoned, which is a continuation of application No. 07/716,865, filed Jun. 18, 1991, now abandoned.

BACKGROUND OF THE INVENTION

1. Field of the Invention

The present invention relates to a speech coding and decoding system and, more particularly, to a speech coding and decoding system which performs a high quality compression and expansion of speech information signals by using a vector quantization technique.

In, for example, an intra-company communication system and a digital mobile radio communication system, a vector quantization method for compressing speech information signals while maintaining speech quality is usually employed. In the vector quantization method, first a reproduced signal is obtained by applying a predication weighting to each signal vector in a codebook, and then an error power between the reproduced signal and an input speech signal is evaluated to determine a number, i.e., index, of the signal vector which provides a minimum error power. A more advanced vector quantization method is now strongly demanded, however, to realize or obtain a higher compression of the speech information.

2. Description of the Related Art

A typical well known high-quality speech coding method is a code excited linear prediction (CELP) coding method which uses the aforesaid vector quantization. One conventional CELP coding is known as a sequential optimization CELP coding, and the other conventional CELP coding is known as a simultaneous optimization CELP coding. These two typical CELP codings will be explained in detail hereinafter.

As will be explained in more detail later, a gain (b) optimization for each vector of an adaptive codebook, and a gain (g) optimization for each vector of a stochastic codebook are carried out sequentially and independently under the sequential optimization CELP coding, and are also carried out simultaneously under the simultaneous optimization CELP coding.

The simultaneous optimization CELP is superior to the sequential optimization CELP from the viewpoint of the realization of a high quality speech reproduction, but the simultaneous optimization CELP has a disadvantage in that a very strong or dependent correlation exists between the gain (b) and the gain (g). That is, if the gain (b) has an incorrect value, the gain (g) also seemingly has an incorrect value.

SUMMARY OF THE INVENTION

Therefore, an object of the present invention is to provide a new concept for realizing a CELP coding in which a very weak or independent correlation exists between the gain (b) and the gain (g), while maintaining the same high performance or quality as that of the simultaneous optimization CELP coding. Under the new CELP coding of the invention, even if either one of the two gains (b or g) becomes invalid, a CELP coding can still be maintained in a more or less normal state by using the other valid gain, which is independent from the aforesaid invalid gain.

To achieve the above-mentioned object, a weighted orthogonalization transforming unit is incorporated in a CELP coding system including at least an adaptive codebook and a stochastic codebook. The weighted orthogonalization transforming unit transforms each code vector devised from the stochastic codebook to a perceptually weighted reproduced code vector which is orthogonal to an optimum pitch prediction vector derived from the adaptive codebook.

BRIEF DESCRIPTION OF THE DRAWINGS

The above object and features of the present invention will be more apparent from the following description of the preferred embodiments with reference to the accompanying drawings, wherein:

FIGS. 16A to 16C depict the arithmetic processing means 61 shown in FIG. 15 in more detail from a mathematical viewpoint;

DESCRIPTION OF THE PREFERRED EMBODIMENTS

Before describing the embodiments of the present invention, the related art and disadvantages thereof will be described with reference to the related figures.

Figure 1:
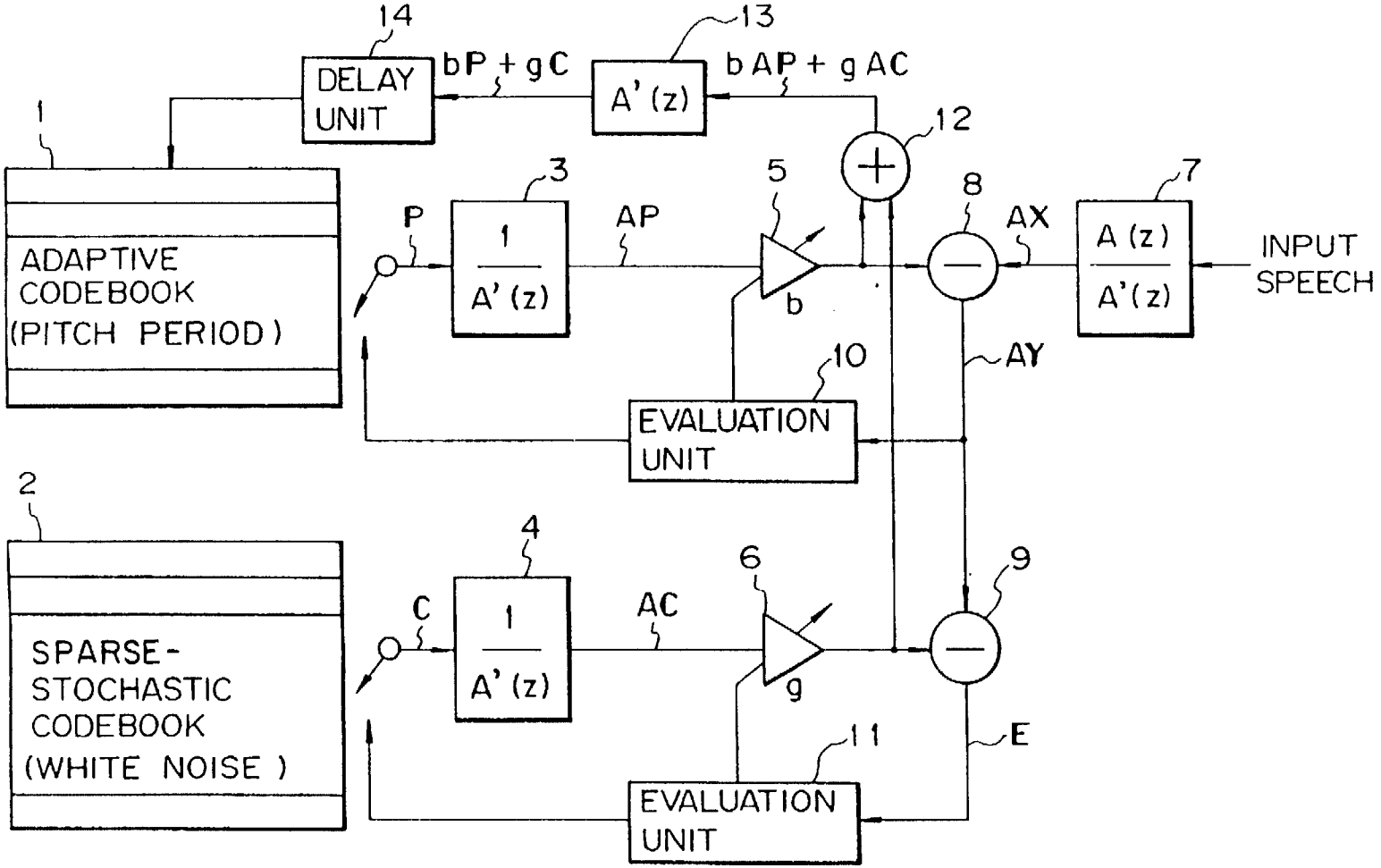
Fig. 1 PRIOR ART
FIG. 1 is a block diagram of a known sequential optimization CELP coding system.
Figure 2:
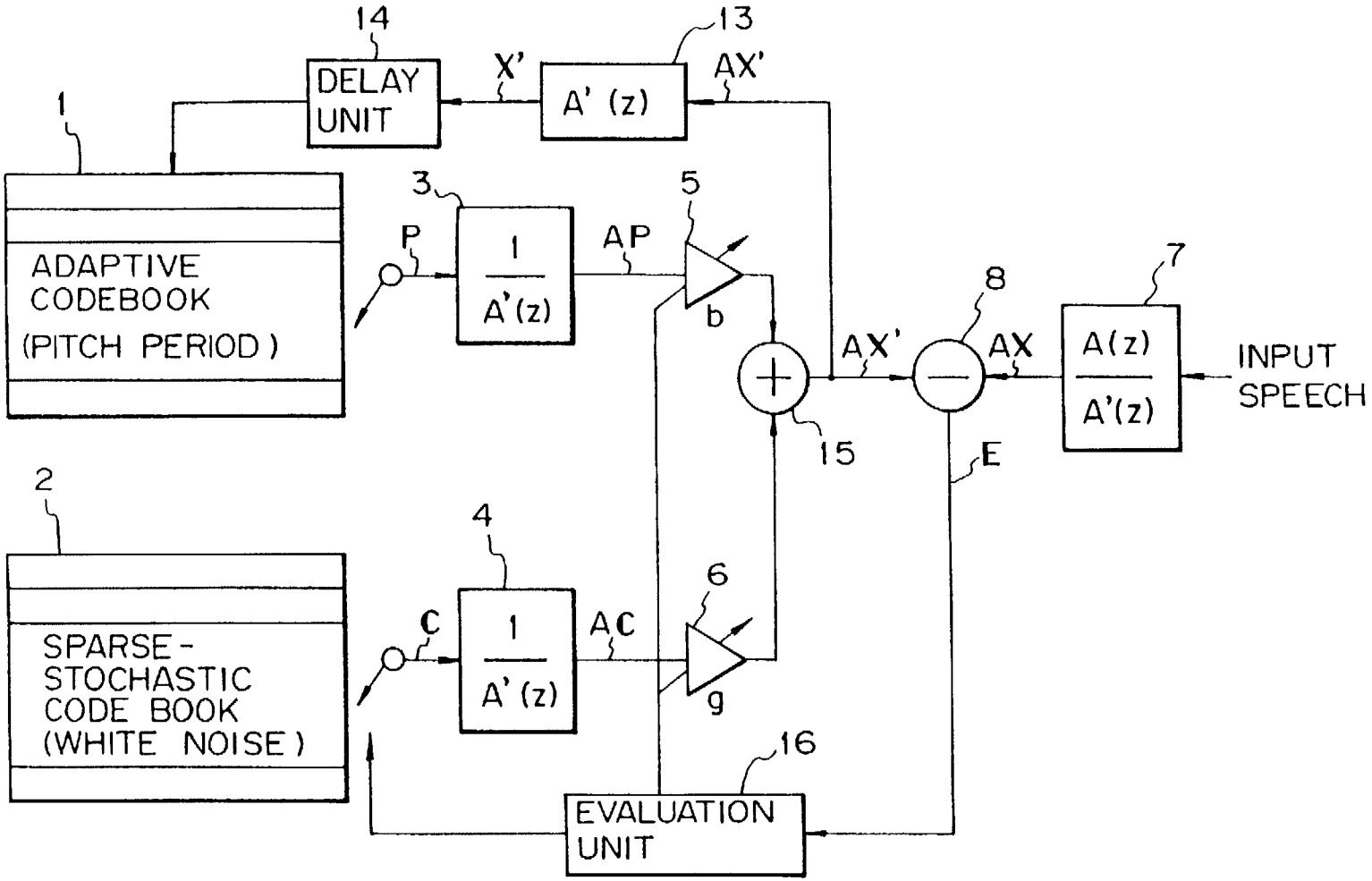
Fig. 2 PRIOR ART
FIG. 2 is a block diagram of a known simultaneous optimization CELP coding system.

FIG. 1 is a block diagram of a known sequential optimization CELP coding system and FIG. 2 is a block diagram of a known simultaneous optimization CELP coding system. In FIG. 1, an adaptive codebook 1 stores therein N-dimensional pitch prediction residual vectors corresponding to N samples in which the pitch period is delayed by one sample. A stochastic codebook 2 stores therein $2^m$-pattern code vectors, each of which code vectors is created by using an N-dimensional white noise vector corresponding to the N samples similar to the aforesaid N samples. In the figure, the codebook 2 is a sparse-stochastic codebook in which some of the sample data, in each code vector stored in the sparse-stochastic codebook 2, having a magnitude lower than a predetermined threshold level, e.g., N/4 samples among N samples, is replaced by zero, and thus the codebook is called a sparse (thinning)stochastic codebook. Each code vector is normalized in such a manner that a power of the N-dimensional elements becomes constant.

First, each pitch prediction residual vector P of the adaptive codebook 1 is perceptually weighted by a perceptual weighting linear prediction synthesis filter 3 indicated as 1/A'(Z), where A'(Z) denotes a perceptual weighting linear prediction analysis filter. The thus-produced pitch prediction vector AP is multiplied by a gain b of a gain amplifier 5, to obtain a pitch prediction reproduced signal vector bAP.

Thereafter, both the pitch prediction reproduced signal vector bAP and an input speech signal vector AX, which has been perceptually weighted by a perceptual weighting filter 7 indicated as A(Z)/A'(Z) (where, A(Z) denotes a linear prediction analysis filter), are applied to a subtracting unit 8 to find a resulting pitch prediction error signal vector AY. An evaluation unit 10 selects an optimum pitch prediction residual vector P from the adaptive codebook 1 for every frame or sample which the pitch period is delayed in such a manner that the power of the pitch prediction error signal vector AY reaches a minimum value, according to the following equation (1). The unit 10 also selects the corresponding optimum gain b.

$$|AY|^2=|AX-bAP|^2$$

Further, each code vector C of the white noise sparse-stochastic codebook 2 is similarly perceptually weighted by a linear prediction synthesis filter 4 to obtain a perceptually weighted code vector AC. The vector AC is multiplied by the gain g of a gain amplifier 6 to obtain a linear prediction reproduced signal vector gAC.

Both the linear prediction reproduced signal vector gAC and the above-mentioned pitch prediction error signal vector AY are applied to a subtracting unit 9, to find a resulting error signal vector E. An evaluation unit 11 selects an optimum code vector C from the codebook 2 for every frame or sample of white noise, in such a manner that the power of the error signal vector E reaches a minimum value, according to the following equation (2). The unit 11 also selects the corresponding optimum gain g.

$$E^2=|AY-gAC|^2$$

The following equation (3) can be obtained from the above-recited equations (1) and (2).

$$E^2=|AX-bAP-gAC|^2$$

Note that the adaptation of the adaptive codebook 1 is performed as follows. First, bAP+gAC is found by an adding unit 12. bAP+gAC is then analyzed to find bP+gC, by a perceptual weighting linear prediction analysis filter (A'(Z)) 13, and then the output from filter 13 is delayed by one frame in a delay unit 14. Thereafter, the thus-delayed frame is stored as a next frame or sample in the adaptive codebook 1, i.e., a pitch prediction codebook.

As mentioned above, the gain b and the gain g are controlled separately under the sequential optimization CELP coding system shown in FIG. 1. In contrast to this, in the simultaneous optimization CELP coding system of FIG. 2, first the bAP and gAC are added by an adding unit 15 to find $$AX'=bAP+gAC$$

Then the input speech signals, perceptually weighted by the filter 7, i.e., AX, and the aforesaid AX', are applied to the subtracting unit 8 to find a error signal vector E according to the above-recited equation (3). An evaluation unit 16 selects a code vector C from the sparse-stochastic codebook 2, which code vector C can bring the power of the vector E to a minimum value. The evaluation unit 16 also controls the simultaneous selection of the corresponding optimum gains b and g.

Note that the adaptation of the adaptive codebook 1 in the above case is similarly performed with respect to AX', which corresponds to the output of the adding unit 12 shown in FIG. 1.

Figure 3:
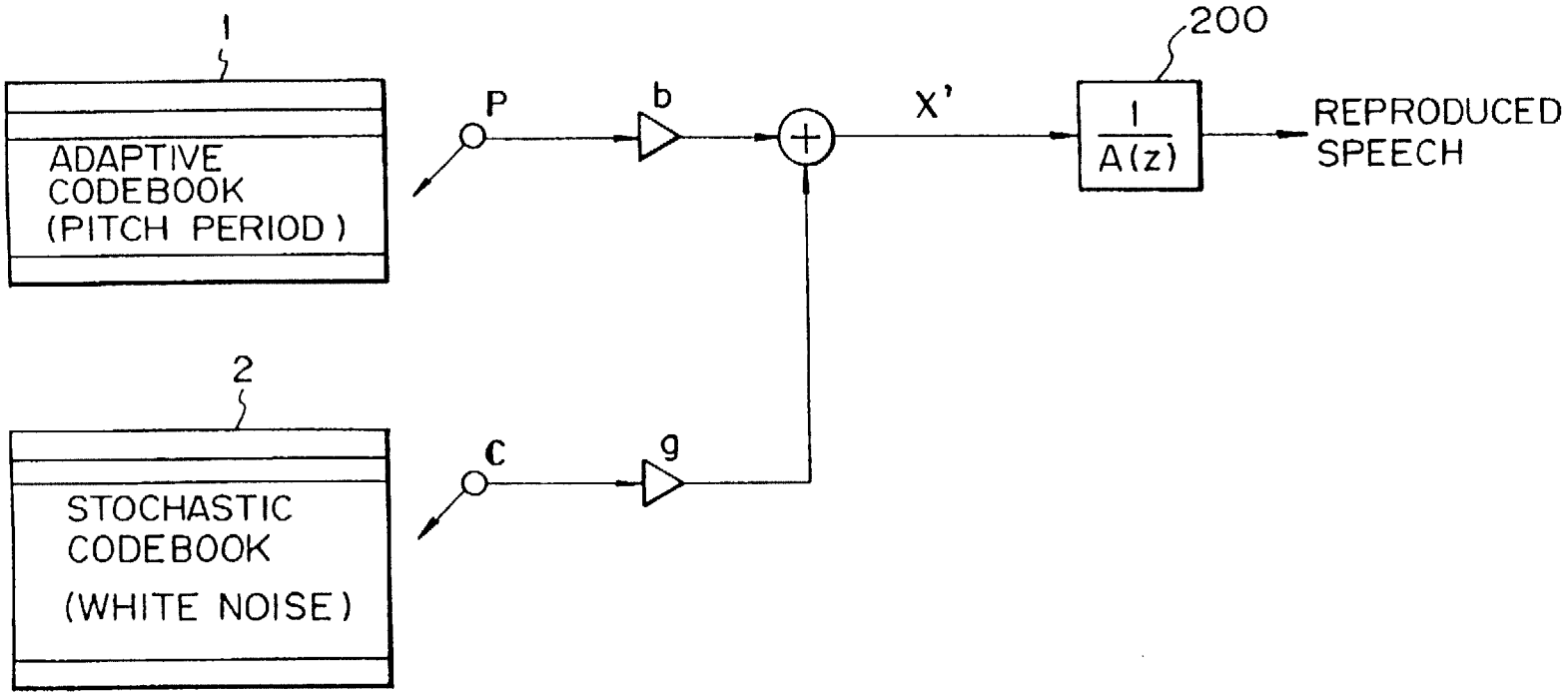
FIG. 3 is a block diagram of a decoding side of a speech coding and decoding system which receives the signal transmitted from a coding side and outputs the reproduced signal.

FIG. 3 is a block diagram of a decoding side of a speech coding and decoding system, which receives the signal transmitted from a coding side and outputs the reproduced signal. At the decoding side of the system, $$X'=bP+gC$$

is found by using the code vector numbers P and C selected and transmitted from the codebooks 1 and 2, and scaling the code vectors P and C using the selected and transmitted gains b 201 and g 202 respectively. The scaled vectors, bP and gC are then added at coding unit 203 to form X'. X' is applied to a linear prediction reproducing filter 200 to obtain the reproduced speech.

Figure 4:
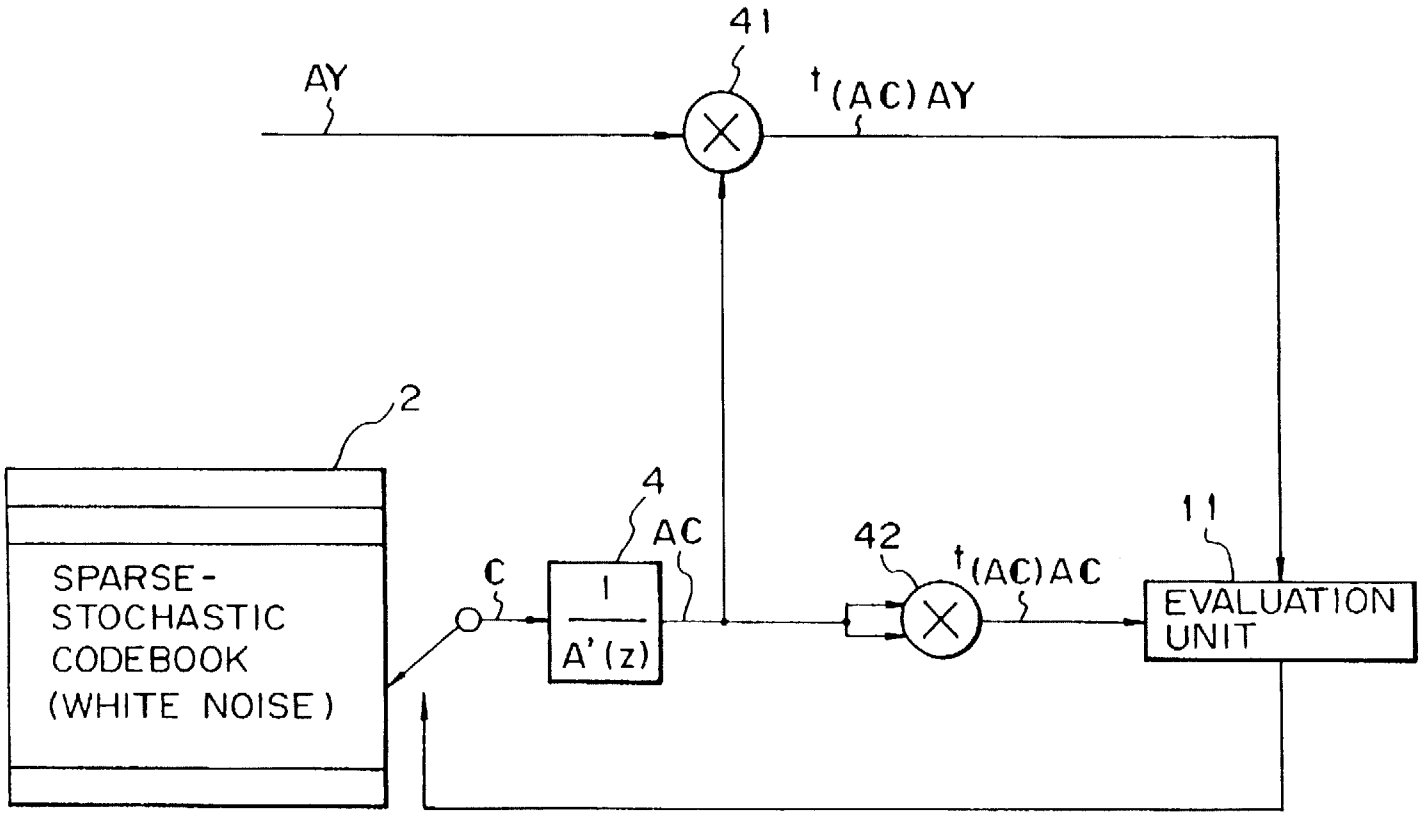
Fig. 4 PRIOR ART
FIG. 4 is a block diagram for conceptually expressing an optimization algorithm under the known sequential optimization CELP coding method.
Figure 5:
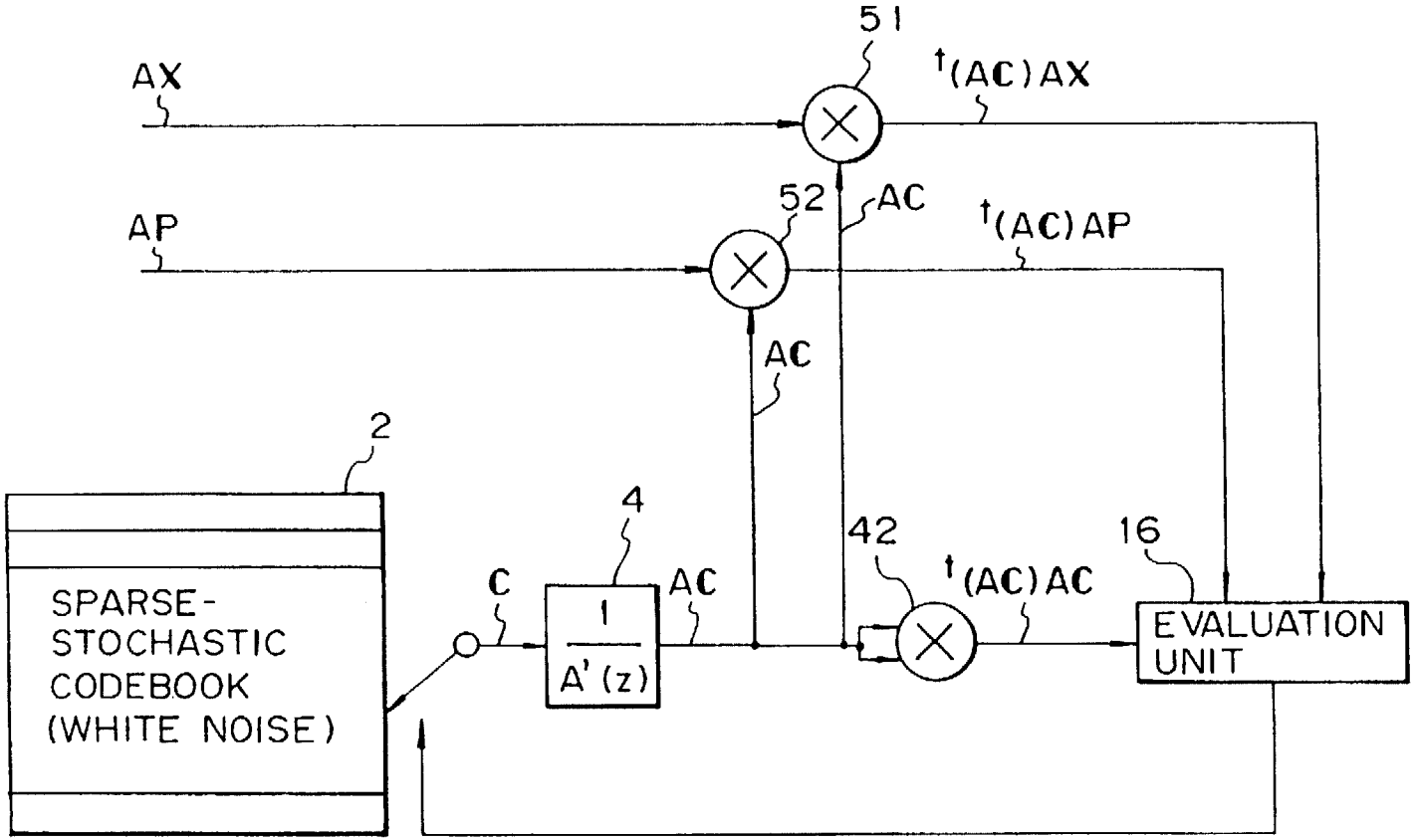
Fig. 5 PRIOR ART
FIG. 5 is a block diagram for conceptually expressing an optimization algorithm under the known simultaneous optimization CELP coding method.

FIG. 4 is a block diagram for conceptually expressing an optimization algorithm under the sequential optimization CELP coding method, and FIG. 5 is a block diagram for conceptually expressing an optimization algorithm under the simultaneous optimization CELP coding method. The gains b and g are depicted conceptionally in FIGS. 1 and 2, but actually are optimized in terms of the code vector (C) from the sparse-stochastic codebook 2, as shown in FIG. 4 or FIG. 5.

Namely, in the case of FIG. 1, based on the above-recited equation (2), the gain g which brings the power of the vector E to a minimum value is found by partially differentiating the equation (2) so that $$0 = \delta(|AY - gAC|^2)/\delta g$$

$$= 2^t(-AC)\,(AY - gAC)$$

and $$g = {}^t(AC)AY/{}^t(AC)AC$$

is obtained, where the symbol "t" denotes a transpose operation.

Referring to FIG. 4, a multiplying unit 41 multiplies the pitch prediction error signal vector AY and the code vector AC, which is obtained by applying each code vector C of the sparse-codebook 2 to the perceptual weighting linear prediction synthesis filter 4, so that a correlation value $${}^t(AC)AY$$

is generated. Then the perceptually weighted and reproduced code vector AC is applied to a multiplying unit 42 to find the autocorrelation value thereof, i.e., $${}^t(AC)AC$$

Thereafter, the evaluation unit 11 selects both the optimum code vector C and the gain g which can minimize the power of the error signal vector E with respect to the pitch prediction error signal vector AY, according to the above-recited equation (4), by using both correlation values $${}^t(AC)AY \text{ and } {}^t(AC)AC$$

Further, in the case of FIG. 2, based on the above-recited equation (3), the gain b and the gain g which bring the power of the vector E to a minimum value are found by partially differentiating the equation (3) so that $$g=[{}^t(AP)AP^t(AC)AX-{}^t(AC)AP^t(AP)AX]/\nabla$$

$$b=[{}^t(AC)AC^t(AP)AX-{}^t(AC)AP^t(AC)AX]/V\nabla$$

where $$\nabla V={}^t(AP)AP^t(AC)AC-({}^t(AC)AP)^2$$

stands.

Then, in FIG. 5, both the perceptually weighted input speech signal vector AX and the reproduced code vector AC, which has been produced by applying each code vector C of the sparse-codebook 2 to the perceptual weighting linear prediction synthesis filter 4, are multiplied by a multiplying unit 51 to generate the correlation value $${}^t(AC)AX$$

therebetween. Similarly, both the perceptually weighted pitch prediction vector AP and the reproduced code vector AC are multiplied by a multiplying unit 52 to generate the correlation value $${}^t(AC)AP$$

At the same time, the autocorrelation value ${}^t(AC)AC$ of the reproduced code vector AC is found by the multiplying unit 42.

Then the evaluation unit 16 simultaneously selects the optimum code vector C and the optimum gains b and g which can minimize the power of the error signal vector E with respect to the perceptually weighted input speech signal vector AX, according to the above-recited equation (5), by using the above mentioned correlation values, i.e., $${}^t(AC)AX,\ {}^t(AC)AP \text{ and } {}^t(AC)AC$$

Thus, the sequential optimization CELP coding method is more advantageous than the simultaneous optimization CELP coding method, from the viewpoint that the former method requires less overall computation than that required by the latter method by comparing the above equations (4) and (5) to each other. Nevertheless, the former method is inferior to the latter method from the viewpoint that the decoded speech quality is low under the former method.

As mentioned previously, the object of the present invention is to provide a new concept for realizing the CELP coding in which a very weak correlation exists between the gain b and the gain g, while maintaining the same performance as that of the simultaneous optimization CELP coding. Under the new CELP coding, even if either one of the two gains b, g becomes invalid, a CELP coding can still be maintained in a more or less normal state by using the other valid gain, which is independent from the aforesaid invalid gain.

Figure 6:
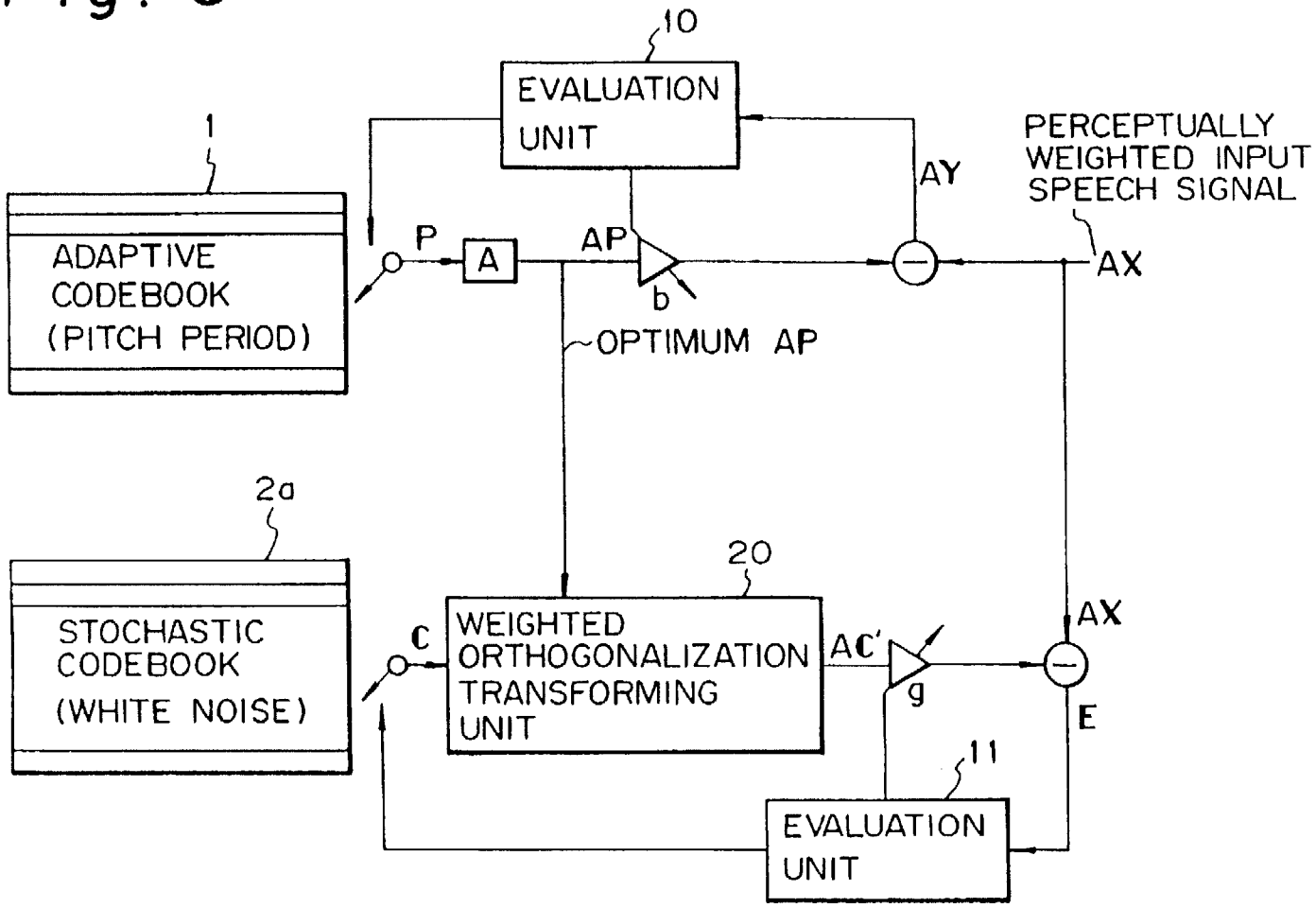
FIG. 6 is a block diagram representing a principle construction of the speech coding system according to the present invention.

FIG. 6 is a block diagram representing a principle construction of the speech coding system according to the present invention. First, regarding the pitch period, the pitch prediction residual vector P selected from the adaptive codebook 1 is perceptually weighted by A as in the prior art, and further multiplied by the gain b to generate the pitch prediction reproduced signal vector bAP. Then a pitch prediction error signal vector AY is generated by applying signal bAP and the perceptually weighted input speech signal vector AX to a subtracting unit. The evaluation unit 10 selects, from the adaptive codebook 1, the pitch prediction residual vector and the gain b; this pitch prediction residual vector minimizes the pitch prediction error signal vector AY.

A feature of the present invention is that a weighted orthogonalization transforming unit 20 is introduced into the system. Unit 20 transforms each code vector of the white noise stochastic codebook 2a to a perceptually weighted reproduced code vector AC' which is orthogonal to the optimum pitch prediction reproduced vector among the perceptually weighted pitch prediction residual vectors.

Figure 7A:
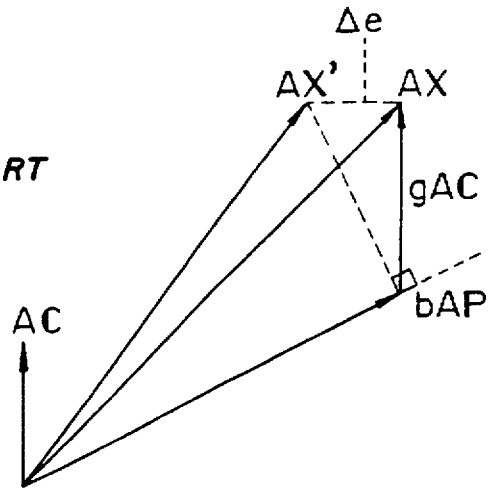
Fig. 7A PRIOR ART
FIG. 7A is a vector diagram representing the conventional sequential optimization CELP coding.
Figure 7B:
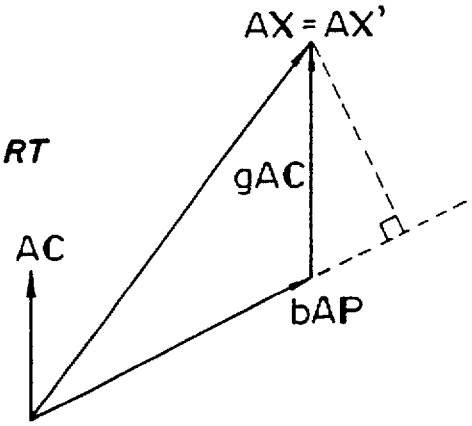
Fig. 7B PRIOR ART
FIG. 7B is a vector diagram representing the conventional simultaneous optimization CELP coding.
Figure 7C:
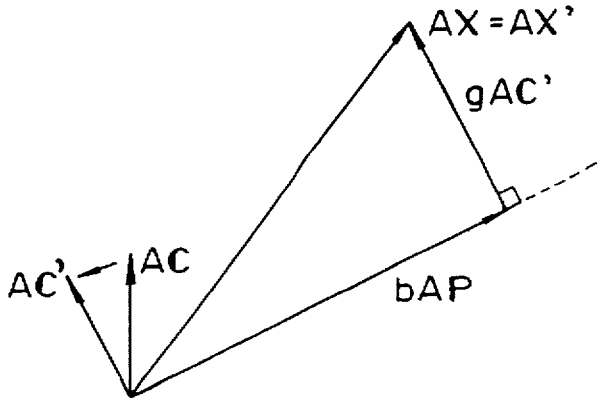
FIG. 7C is a vector diagram representing a gain optimization CELP coding according to the present invention.

FIG. 7A is a vector diagram representing the conventional sequential optimization CELP coding. FIG. 7B is a vector diagram representing the conventional simultaneous optimization CELP coding. FIG. 7C is a vector diagram representing a gain optimization CELP coding according to the present invention.

The principle of the above feature will be clarified with reference to FIG. 7C. Note, under the sequential optimization coding method (FIG. 7A), a quantization error is made large as depicted by Δe in FIG. 7A, since the code vector AC, which has been taken as the vector C from the codebook 2 and perceptually weighted by A, is not orthogonal relative to the perceptually weighted pitch prediction reproduced signal vector bAP. Based on the above, if the code vector AC is transformed to the code vector AC' which is orthogonal to the pitch prediction residual vector AP, by a known transformation method, the quantization error can be minimized, even under the sequential optimization CELP coding method of FIG. 7A, to a quantization error comparable to one occurring under the simultaneous optimization method (FIG. 7B).

In FIG. 7C, the gain g is multiplied with the thus-obtained code vector AC' to generate the linear prediction reproduced signal vector gAC'. The evaluation unit 11 selects the code vector from the codebook 2 and selects the gain g, which can minimize the linear prediction error signal vector E by using the thus generated gAC' and the perceptually weighted input speech signal vector AX.

Thus, upon applying the orthogonalization transform to the code vector, the sequential optimization is performed whereby the synthesis vector AX' connected to the vectors bAP and the gAC' become close to or coincides with the actual perceptually weighted input speech signal vector AX minimizing the quantization error. For example, for a two-dimensional vector (N=2 where N denotes the dimension of the vector), the vector diagrams shown in FIGS. 7A to 7C are applicable. Particularly, as understood from FIG. 7A, i.e., under the conventional sequential optimization method, AX does not correctly coincide with AX', i.e., AX≠AX'. Conversely, under the conventional simultaneous optimization method (FIG. 7B) and the gain optimization method of the present invention (FIG. 7C), AX does correctly coincide with AX', i.e., AX=AX'.

Assuming that N>2, i.e., a three or more dimensional vector exists, AX=AX' cannot be satisfied even by the methods of FIG. 7B and FIG. 7C. Nevertheless, the quantization error between the two (AX, AX') can be made smaller using the gain optimization method than the sequential optimization method of FIG. 7A.

Figure 8:
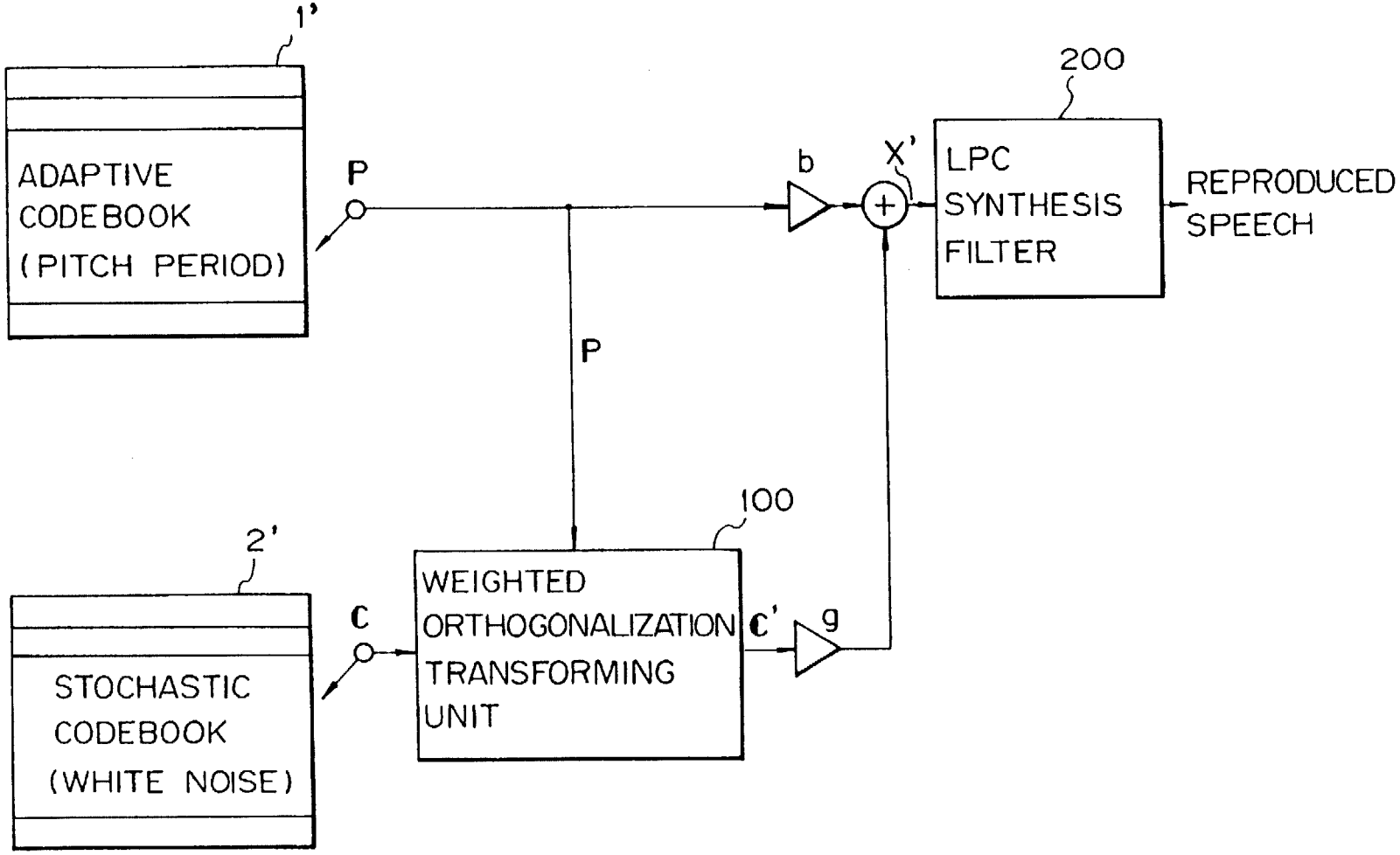
FIG. 8 is a block diagram showing a principle construction of the decoding side facing the coding side shown in FIG. 6.

FIG. 8 is a block diagram showing a principle construction of the decoding side facing the coding side of the speech coding and decoding system shown in FIG. 6. A weighted orthogonalization transforming unit 100 is incorporated into the decoding system. The unit 100 transforms the optimum code vector C selected from the white noise stochastic codebook 2' to the code vector C', which will be orthogonal after applying the perceptual weighting, to the pitch prediction residual vector P of an adaptive codebook 1', after applying the perceptual weighting thereto, whereby AP is perpendicular to AC'.

Here, the original speech can be reproduced by applying a vector X' to a linear prediction synthesis filter 200, which vector X' is obtained by adding both the code vector gC' and the vector bP. gC' is obtained by multiplying the gain g with the aforesaid code vector C' and bP is obtained by multiplying the gain b with the aforesaid vector P.

Figure 9:
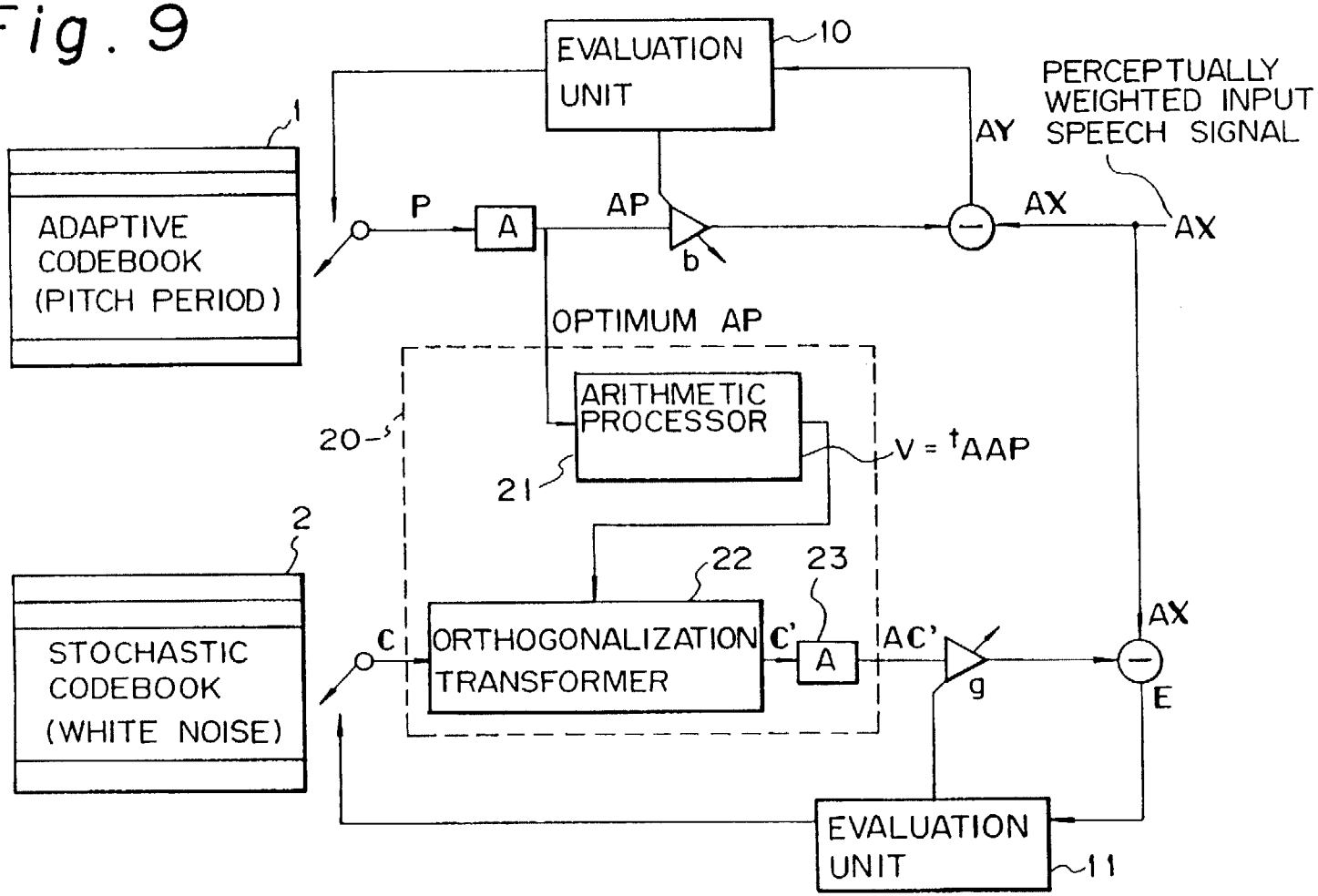
FIG. 9 is a block diagram of the present invention in FIG. 6, in which the weighted orthogonalization transforming unit 20 is illustrated in more detail.

FIG. 9 is a block diagram of the invention in FIG. 6, in which the weighted orthogonalization transforming unit 20 is illustrated in more detail. In FIG. 9, the unit 20 is primarily comprised of an arithmetic processing means 21, an orthogonalization transformer 22, and a perceptual weighting matrix 23. The arithmetic processing means 21 applies a backward perceptual weighting to the optimum pitch prediction vector AP selected from the pitch codebook 1 to calculate an arithmetic sub-vector $$V={}^{t}AAP$$

where the term backward represents an inverse operation in time.

The orthogonalization transformer 22 receives each or all of the code vectors C from the codebook 2 and generates the code vectors C' orthogonal to the aforesaid arithmetic sub-vector V.

The perceptual weighting matrix 23 produces the perceptually weighted code vector AC' by applying the perceptual weighting A to the orthogonalized code vector C'.

Accordingly, the arithmetic sub-vector V is generated, and therefore, the orthogonalization transformer 22 alone can produce the code vector C' which is orthogonalized relative to the vector V. Thus a known Gram-Schmidt orthogonal transforming method or a known householder transforming method can be utilized for realizing the orthogonalization transformer 22.

Figure 10:
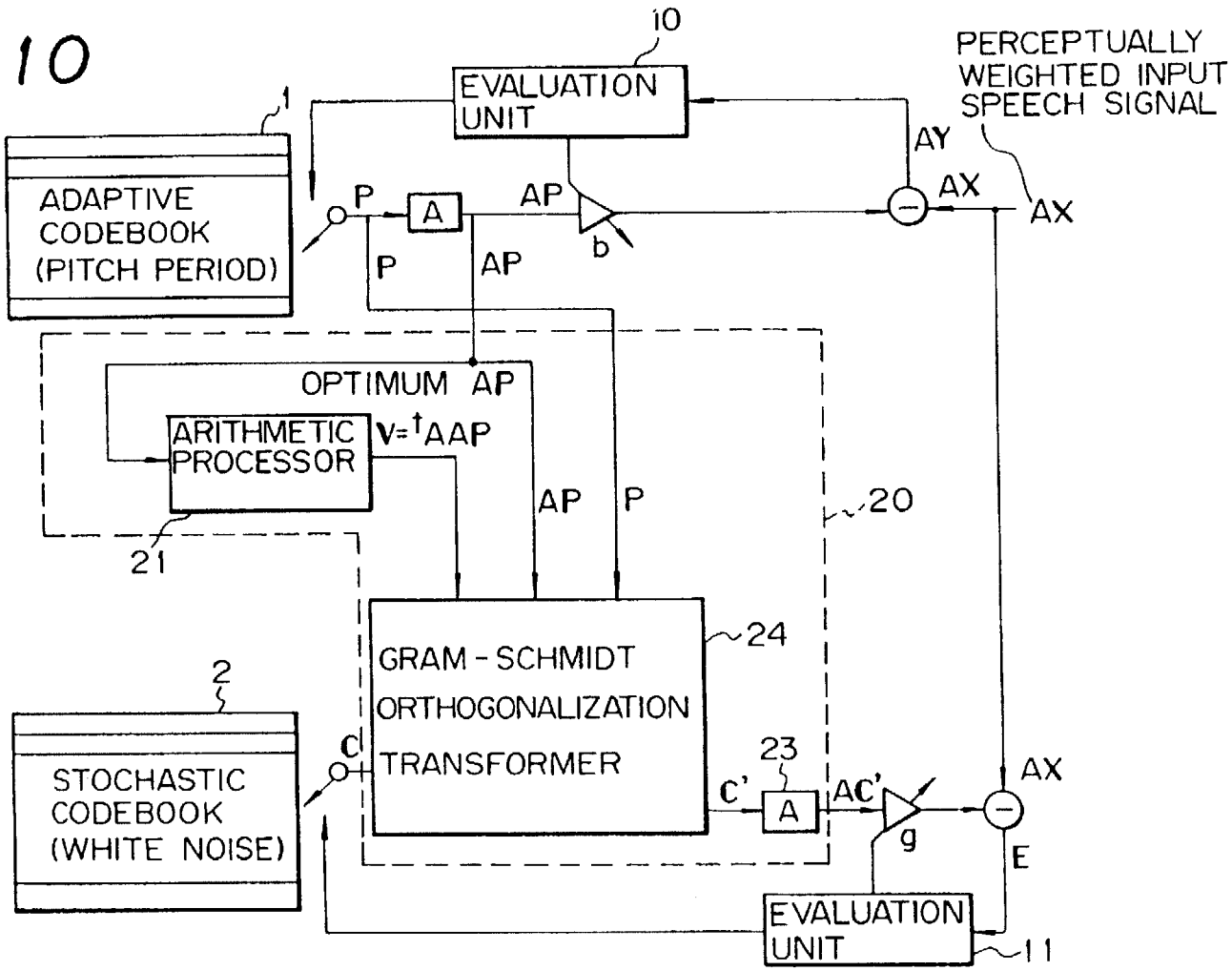
FIG. 10 is a block diagram of FIG. 9, in which a first example of orthogonalization transformer 22 is illustrated in more detail.

FIG. 10 is a block diagram of FIG. 9 in which a first example of orthogonalization transformer 22 is illustrated in more detail. In the figure, the arithmetic processing means 21 and the perceptual weighting matrix 23 are identical to those shown in FIG. 9. In FIG. 10, the orthogonalization transformer 22 of FIG. 9 is realized as a Gram-Schmidt orthogonalization transformer 24. The Gram-Schmidt transformer 24 receives four vectors, i.e., the optimum pitch prediction residual vector P, the perceptually weighted optimum pitch prediction vector AP, the aforesaid arithmetic sub-vector V, and each or all of the code vectors C from the codebook 2, so that the code vector C' produced therefrom is orthogonal to the arithmetic sub-vector V.

As mentioned above, in FIG. 10, the vector C' orthogonal to the vector V is generated from the Gram-Schmidt orthogonalization transformer 24 by using the optimum pitch prediction residual vector P and the perceptually weighted vector AP, in addition to the arithmetic sub-vector V used in FIG. 9. The vector AC', which is obtained by applying the perceptual weighting A to the thus generated vector C', can be defined on the same plane which is defined by the vectors AC and AP. Therefore, it is not necessary to newly design a coder for the gain g, which means that the coder for the gain g can be used in the same way as in the prior art sequential optimization CELP coding method.

Figure 11:
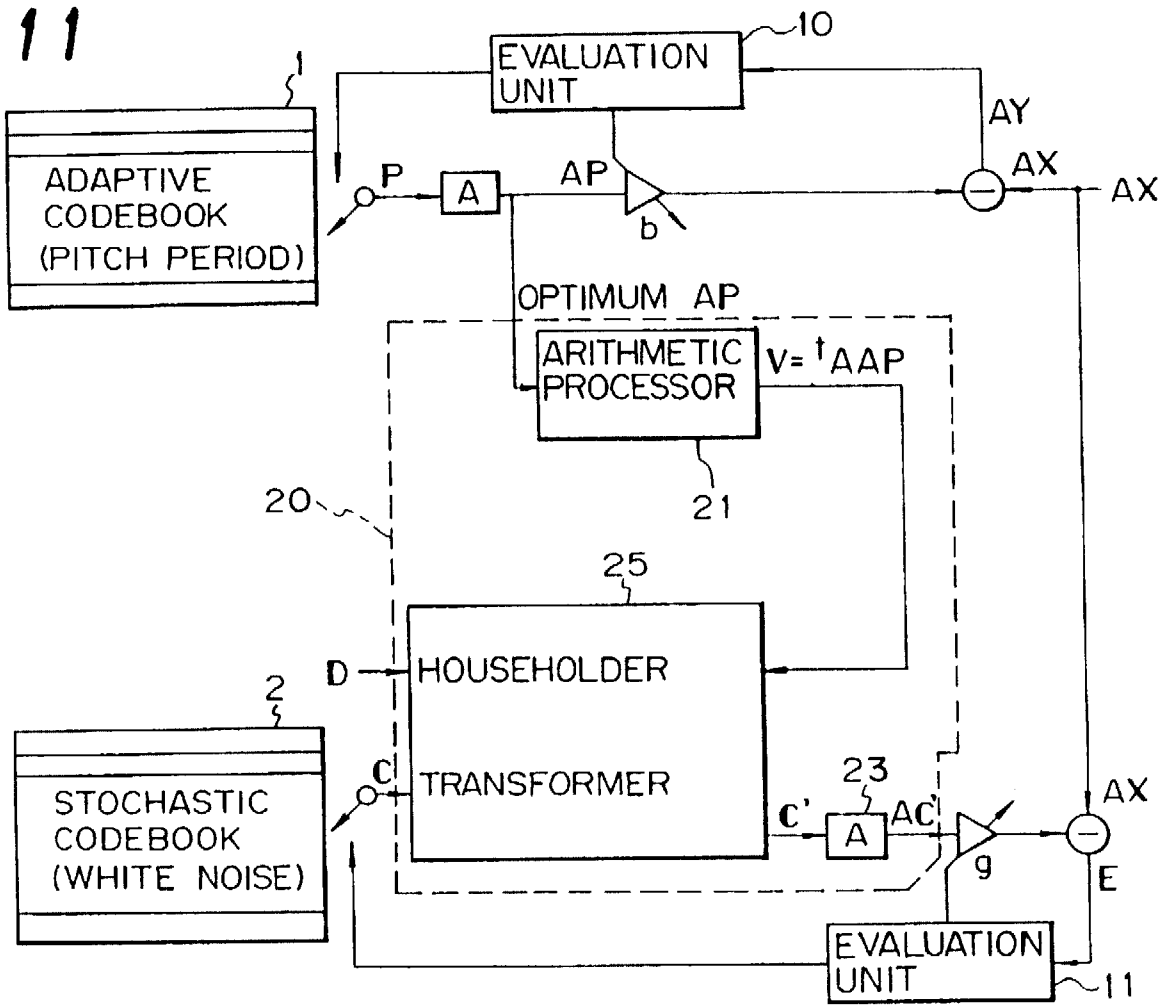
FIG. 11 is a block diagram of FIG. 9, in which a second example of orthogonalization transformer 22 is illustrated in more detail.

FIG. 11 is a block diagram of FIG. 9, in which a second example of orthogonalization transformer 22 is illustrated in more detail. In the figure, the arithmetic processing means 21 and the perceptual weighting matrix 23 are identical to those shown in FIG. 9. The orthogonalization transformer 22 of FIG. 9 is realized, in FIG. 11, as a householder transformer 25. The householder transformer 25 receives three vectors, i.e., the arithmetic sub-vector V, each or all of the code vectors C of the codebook 2 and a vector D which is orthogonal to all of the code vectors stored in the codebook 2. Householder transformer 25 then generates a code vector C' by using the above three vectors with C' being orthogonal to the aforesaid arithmetic sub-vector V.

Therefore, the householder transformer 25 uses the vector D, which is orthogonal to all of the vectors in the codebook 2, and if the vector D is, e.g., [1, 0, 0,—0], the codebook 2 can be set up in advance as $|0, C_{11}, C_{12}, —, C_{1N-1}|$ $|0, C_{21}, C_{22}, —, C_{2N-1}|$ for example, whereby the number of dimensions of the codebook 2 can be reduced to N-1 where N represents the number of samples for each code vector and stored in codebook 2.

Figure 12:
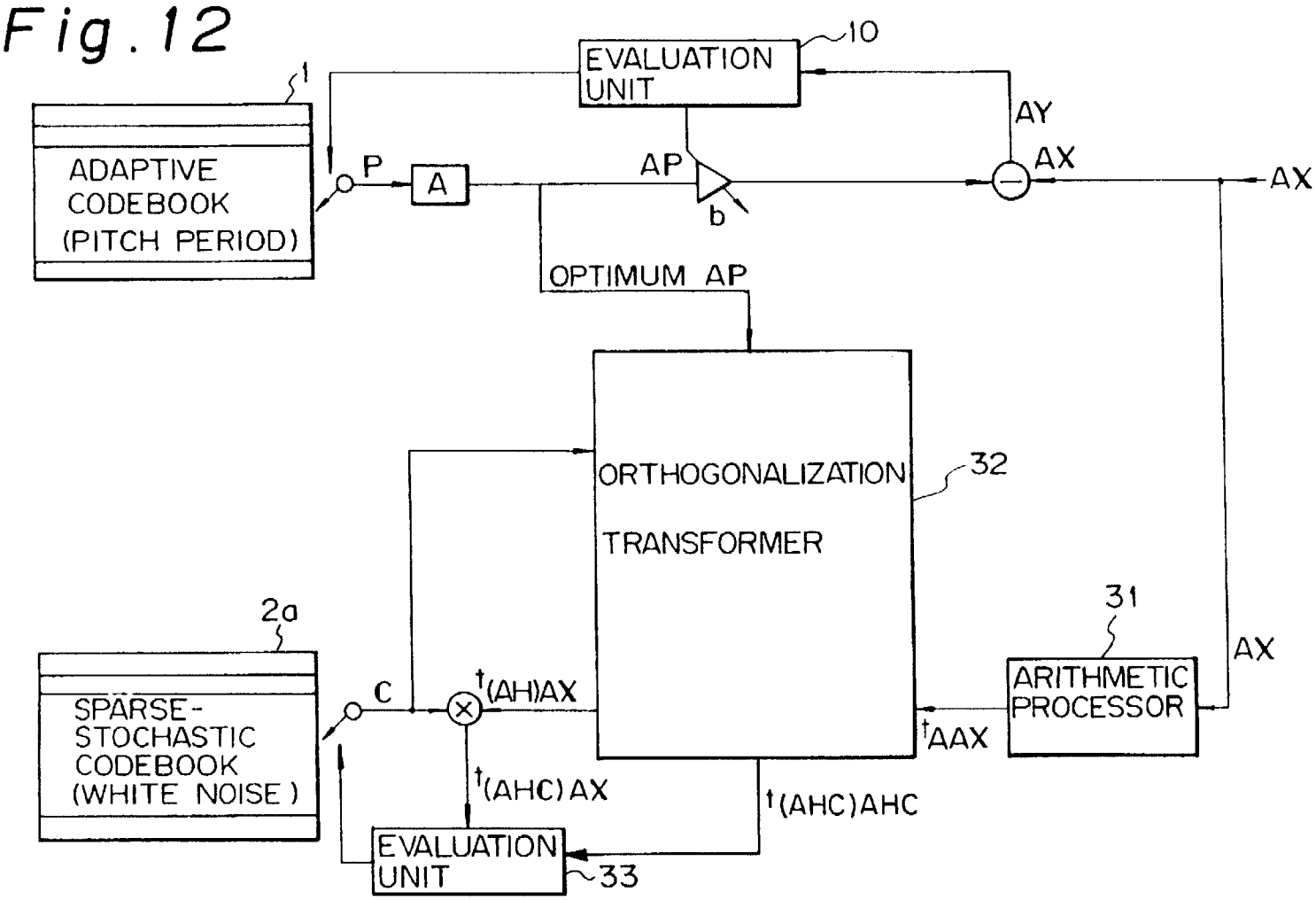
FIG. 12 is a block diagram representing a principle construction of the invention in FIG. 6, except that a sparse-stochastic codebook is used instead of the stochastic codebook.

FIG. 12 is a block diagram representing a principle construction of the invention in FIG. 6, except that a sparse-stochastic codebook is used instead of the stochastic codebook. In the system of FIG. 12, since the sparse-stochastic codebook 2*a* is in a state wherein some code vectors are thinned out, it is preferable to realize the above-mentioned orthogonalization transformation while maintaining the sparse state as much as possible.

Accordingly, an arithmetic processing means 31 calculates a vector $^t$AAX by applying the aforesaid backward perceptual weighting to the input speech signal vector AX. The backward perceptually weighted vector $^t$AAX is backwardly and perceptually weighted and then othogonally transformed, with respect to the optimum pitch prediction vector AP among the perceptually weighted pitch prediction residual vectors, so that an input speech signal vector t (AH) AX is generated from an orthogonalization transformer 32. The vector t(AH)AX is used to find a correlation value $^t$(AHC)AX with each or all of the code vectors C from the sparse-stochastic codebook 2*a*.

Further, the orthogonalization transformer 32 finds an autocorrelation value $^t$(AHC)AHC of a vector AHC (corresponding to the aforesaid AC'), by using both or all of the code vectors C of the codebook 2*a* and the optimum pitch prediction vector AP, in which vector AHC is orthogonal to the optimum pitch prediction vector AP and is perceptually weighted at the orthogonalization transformer 32.

Then, both of the thus found correlation values $^t$(AHC) AX and $^t$(AHC)AHC are adapted to the above-recited equation (4) by an evaluation unit 33 to thereby select a code vector from the codebook 2*a*, which code vector can minimize the linear prediction error, and the evaluation unit 33 also selects the optimum gain g.

Accordingly, a computation amount can be reduced when compared to the computation amount needed in the structure, such as that shown in FIG. 4, in which the code vectors become non-sparse code vectors after passing through the perceptual weighting matrix A, since, by using the backward orthogonalization transforming matrix H, the sparse-code vectors C are applied as they are for the correlation calculation.

Figure 13:
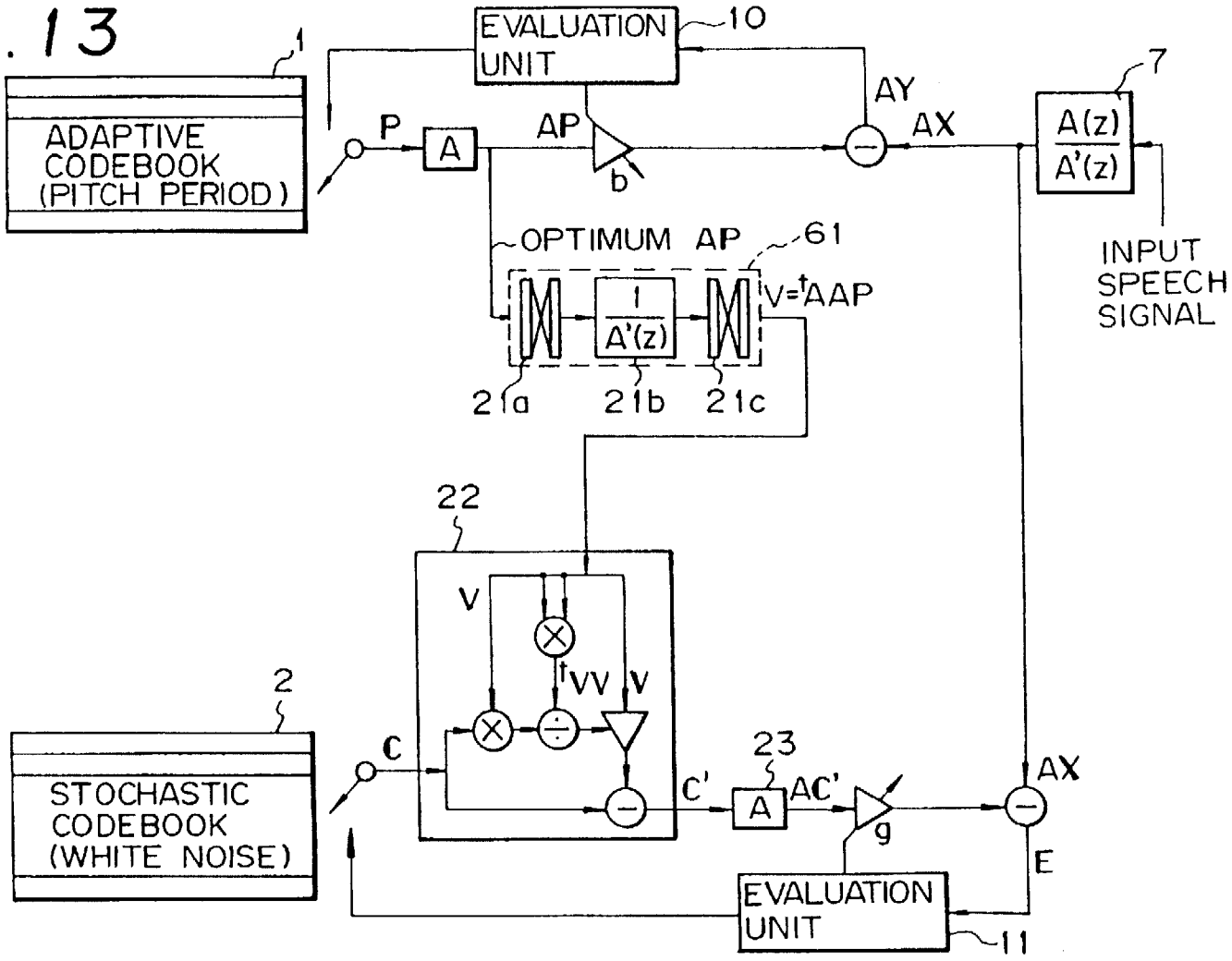
FIG. 13 is a block diagram showing a first embodiment of the coding system illustrated in FIG. 9.

FIG. 13 is a block diagram showing a first embodiment of the coding system illustrated in FIG. 9 in which FIG. 9 is a block diagram of the invention with the weighted orthogonalization transforming unit 20 illustrated in more detail. In this embodiment, the arithmetic processing means 21 of FIG. 3 is comprised of members 21*a*, 21B and 21*c* forming an arithmetic processing means 61. The member 21*a* is a backward unit 21*a* which rearranges the input signal (optimum AP) inversely along a time axis. The member 21*b* is an infinite impulse response (IIR) perceptual weighting filter, which is comprised of a matrix A (=1/A'(Z)). The member 21*c* is another backward unit which rearranges the output signal from the filter 21*b* inversely along a time axis. Accordingly, the arithmetic sub-vector V (=$^t$AAP) is generated thereby.

Figures 14A, 14B, 14C, 14D, 15:
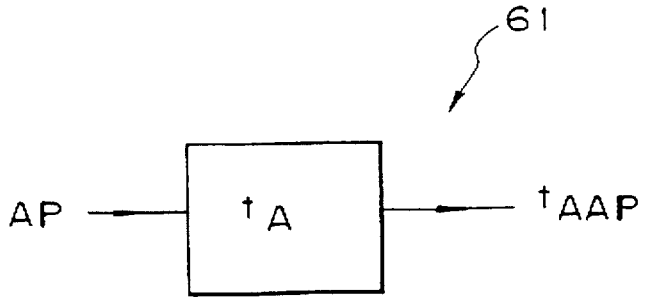
FIGS. 14A to 14D depict a first example of the arithmetic processing means 61 shown in FIG. 13 in more detail and from a mathematical viewpoint.
FIG. 15 illustrates a second example of the arithmetic processing means 61 shown in FIG. 13.

FIGS. 14A to 14D depict a first example of the arithmetic processing means 61 shown in FIG. 13 in more detail and from a mathematical viewpoint. Assuming that the perceptually weighted pitch prediction vector AP is expressed as shown in FIG. 14A, a vector $(AP)_{TR}$ becomes as shown in FIG. 14B, which is obtained by rearranging the elements of FIG. 14A inversely along a time axis. That is, $(AP)_{TR}$ is the time reverse of the matrix AP.

The vector $(AP)_{TR}$ of FIG. 14B is applied to the IIR perceptual weighting linear prediction synthesis filter (A) 21*b* having a perceptual weighting filter function 1/A'(Z), to generate the $A(AP)_{TR}$ as shown in FIG. 14C.

In this case, the matrix A corresponds to a reversed matrix of the transpose matrix, i.e., $^t$A, and therefore, the above recited A(AP)TR is rearranged inversely along a time axis, as shown in FIG. 14D, so that the $A(AP)_{TR}$ is reversed and returned to its original form.

Further, the arithmetic processing means 61 of FIG. 13 may be constructed by using a finite impulse response (FIR) perceptual weighting filter which multiplies the input vector AP with a transpose matrix, i.e., $^t$A. An example thereof is shown in FIG. 15.

FIG. 15 illustrates a second example of the arithmetic processing means 61 shown in FIG. 13, and FIGS. 16A to 16C depict the arithmetic processing means 61 shown in FIG. 15 in more detail and from a mathematical viewpoint. In the FIGS. 16A to 16C, it is assumed that the FIR perceptual weighting filter matrix is set as A, and the transpose matrix $^t$A of the matrix A is an NXN-dimensional matrix, as shown in FIG. 16A, corresponding to the number of the dimensions NXN of the codebook. It is also assumed that the perceptually weighted pitch prediction residual vector AP is formed as shown in FIG. 16B (this corresponds to a time-reversing vector of FIG. 14B). Then the time-reversing perceptual weighting pitch prediction residual vector $^t$AAP becomes a vector as shown in FIG. 16C, which vector is obtained by multiplying the above-mentioned vector AP with the transpose matrix $^t$A. Note, in FIG. 16C, the symbol * is a multiplication symbol, and the accumulated multiplication number or calculations becomes $N^2/2$ in this case.

Therefore, the result of FIG. 14D and the result of FIG. 16C become the same.

Although, in FIGS. 14A to 14D, the filter matrix A is formed as the IIR filter, it is also possible to use the FIR filter therefor. If the FIR filter is used, however, the number of entire calculations becomes $N^2/2$ plus 2N times shift operations as in the embodiment of FIGS. 16A to 16C. Conversely, if the IIR filter is used, and assuming that a tenth order linear prediction analysis is achieved as an example, only 10N calculations plus 2N shift operations will suffice for the related arithmetic processing.

Referring again to FIG. 13, the orthogonalization transformer 22 is supplied with the arithmetic sub-vector V (=$^t$AAP) generated through the above-mentioned process. The transformer 22 then generates the vector C' by applying the orthogonalization transformation to the code vectors C given from the codebook 2, such that the vector C becomes orthogonal relative to the aforesaid vector V.

In the above case, an orthogonalization arithmetic equation of $$C' = C - V\,(^tVC/^tVV) \qquad (6)$$

i.e., a Gram-Schmidt orthogonalization transforming equation, can be used. Note, in the figure each circle represents a vector operation and each triangle represents a scalar or gain operation.

Figure 17A:
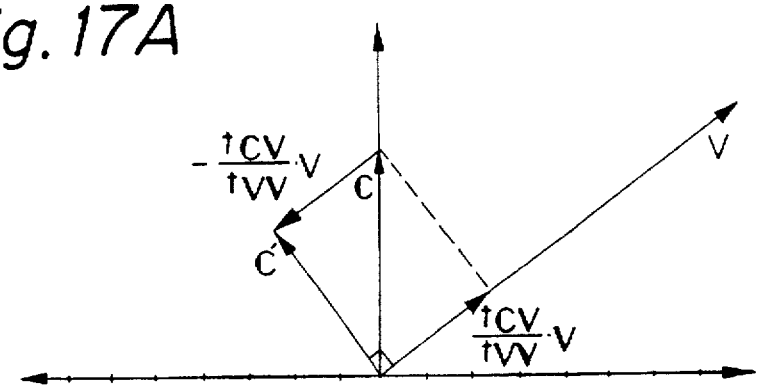
FIG. 17A is a vector diagram representing a Gram-Schmidt orthogonalization transform.

FIG. 17A is a vector diagram representing a Gram-Schmidt transform.

Figure 17B:
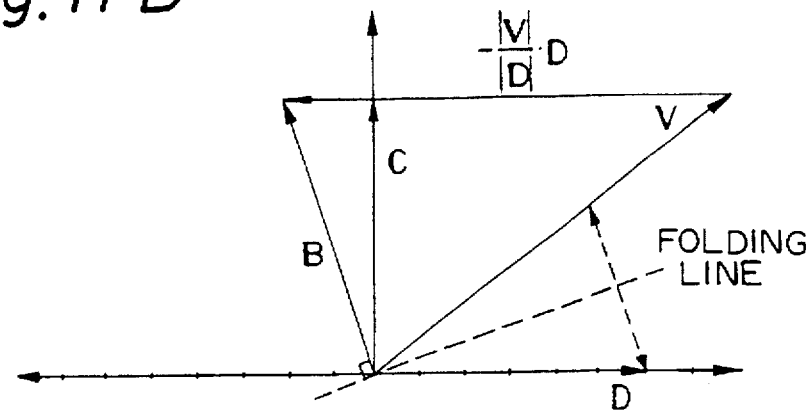
FIG. 17B is a vector diagram representing a householder transform used to determine an intermediate vector B.

FIG. 17B is a vector diagram representing a householder transform used to determine an intermediate vector.

Figure 17C:
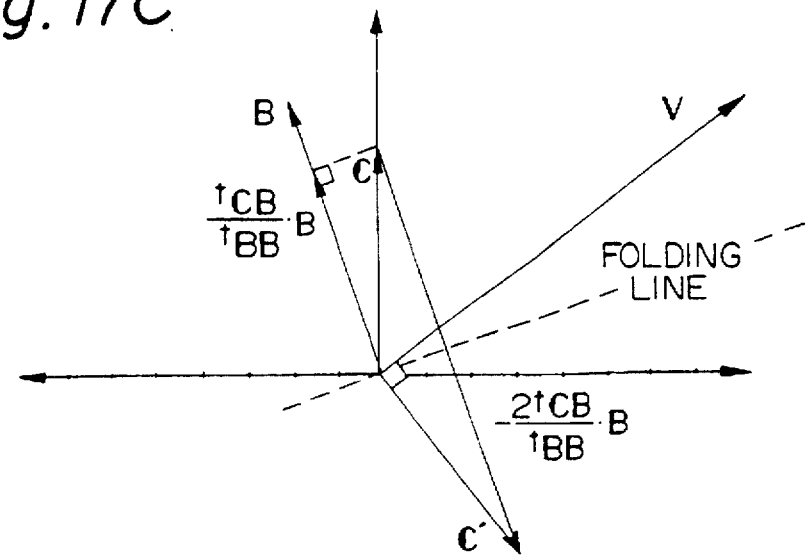
FIG. 17C is a vector diagram representing a householder transform used to determine a final vector C'.

FIG. 17C is a vector diagram representing a householder orthogonalization transform used to determine a final vector C'.

Referring to FIG. 17A, a parallel component of the code vector C relative to the vector V is obtained by multiplying the unit vector ($V/{}^tVV$) of the vector V with the inner product ${}^tCV$ therebetween, and the result becomes $$ {}^tCV(V/{}^tVV) $$

Consequently, the vector C' orthogonal to the vector V can be given by the above-recited equation (6).

The thus-obtained vector C' is applied to the perceptual weighting filter 23 in FIG. 13 to produce the vector AC'. The optimum code vector C and gain g can be selected by adapting the above vector AC' to the sequential optimization CELP coding shown in FIG. 4.

Figure 18:
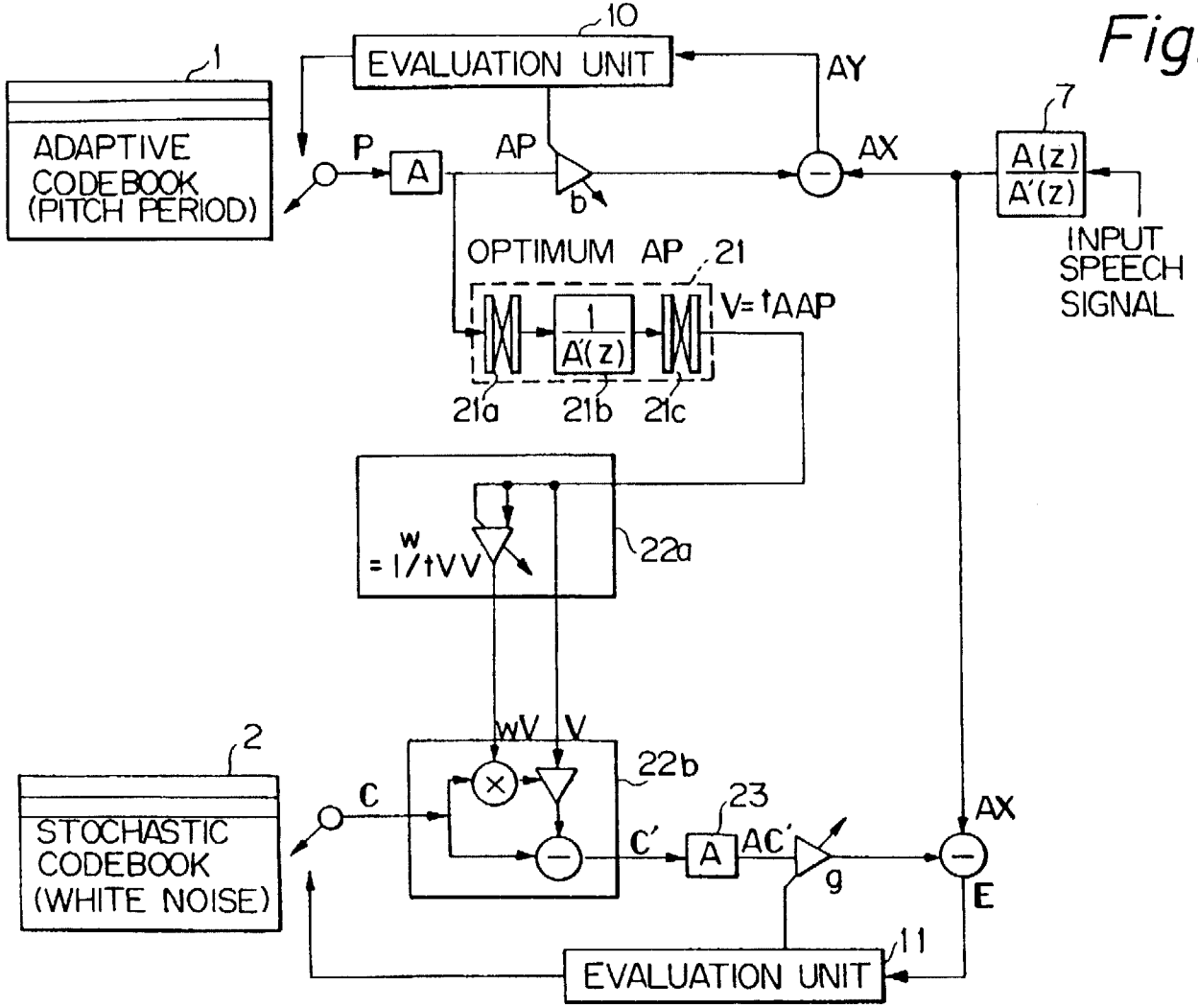
FIG. 18 is a block diagram showing a second embodiment modifying the first embodiment shown in FIG. 13.

FIG. 18 is a block diagram showing a second embodiment modifying the first embodiment shown in FIG. 13. Namely, the orthogonalization transformer 22 of FIG. 13 is divided into an arithmetic processor 22*a* and an arithmetic processor 22*b*, and the arithmetic processor 22*a* is given the arithmetic sub-vector V to generate two vectors, i.e., a vector wV ($w=1/{}^tVV$) and a vector V. The two vectors are then provided to the arithmetic processor 22*b* to produce the vector C', which is orthogonal to the vector V. The arithmetic equation used in this case is based on the above-recited equation used in this case is based on the above-recited equation (6), i.e., the Gram-Schmidt orthogonalization transforming equation. The difference between this example and the aforesaid orthogonalization transformer 22 of FIG. 13 is that this example makes it possible to achieve an off-line calculation for the division part, i.e., $1/{}^tVV$, among the calculations of the Gram-Schmidt orthogonalization transforming equation. This enables a reduction of the computation amount.

Figure 19:
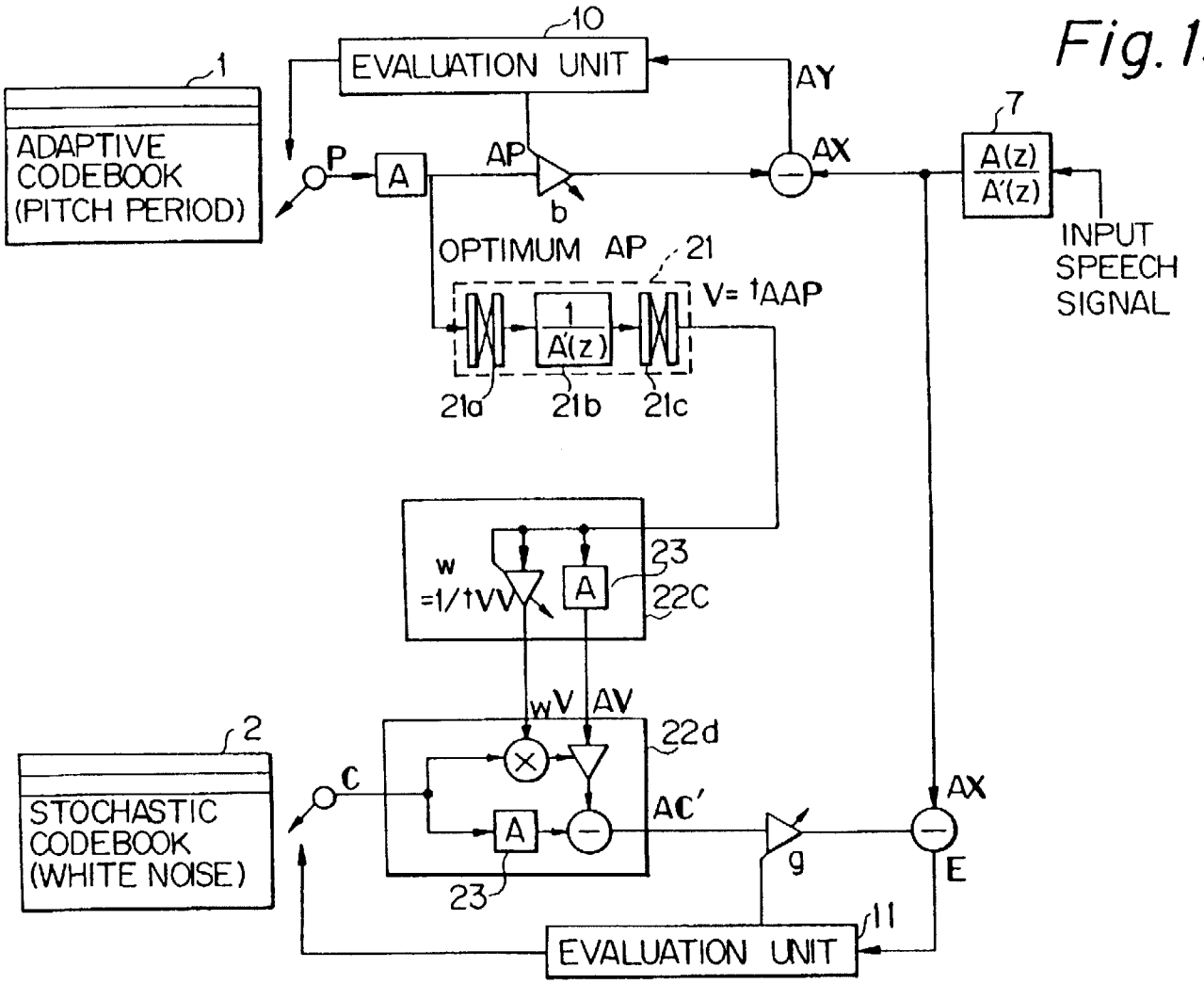
FIG. 19 is a block diagram showing a third embodiment modifying the first embodiment shown in FIG. 13.

FIG. 19 is a block diagram showing a third embodiment modifying the first embodiment shown in FIG. 13. In the example, the perceptual weighting matrix A is incorporated into each of the arithmetic processors 22*a* and 22*b* shown in FIG. 18. First, an arithmetic processor 22*c* (22*a* in FIG. 18) generates a vector wV and a perceptually weighted vector AV by using the arithmetic sub-vector V. Next, based on the above vectors, an arithmetic processor 22*d* (22*b* in FIG. 18) generates the vector AC' from the perceptually weighted code vector AC, which vector AC' is orthogonal to the perceptually weighted pitch prediction residual vector AP.

The arithmetic equation used in the above case is shown below.

$$ \begin{aligned} AC' &= AC - {}^tC(V/{}^tVV)AV \\ &= A\{C - V({}^tVC/{}^tVV)\} \end{aligned} $$

Figure 20:
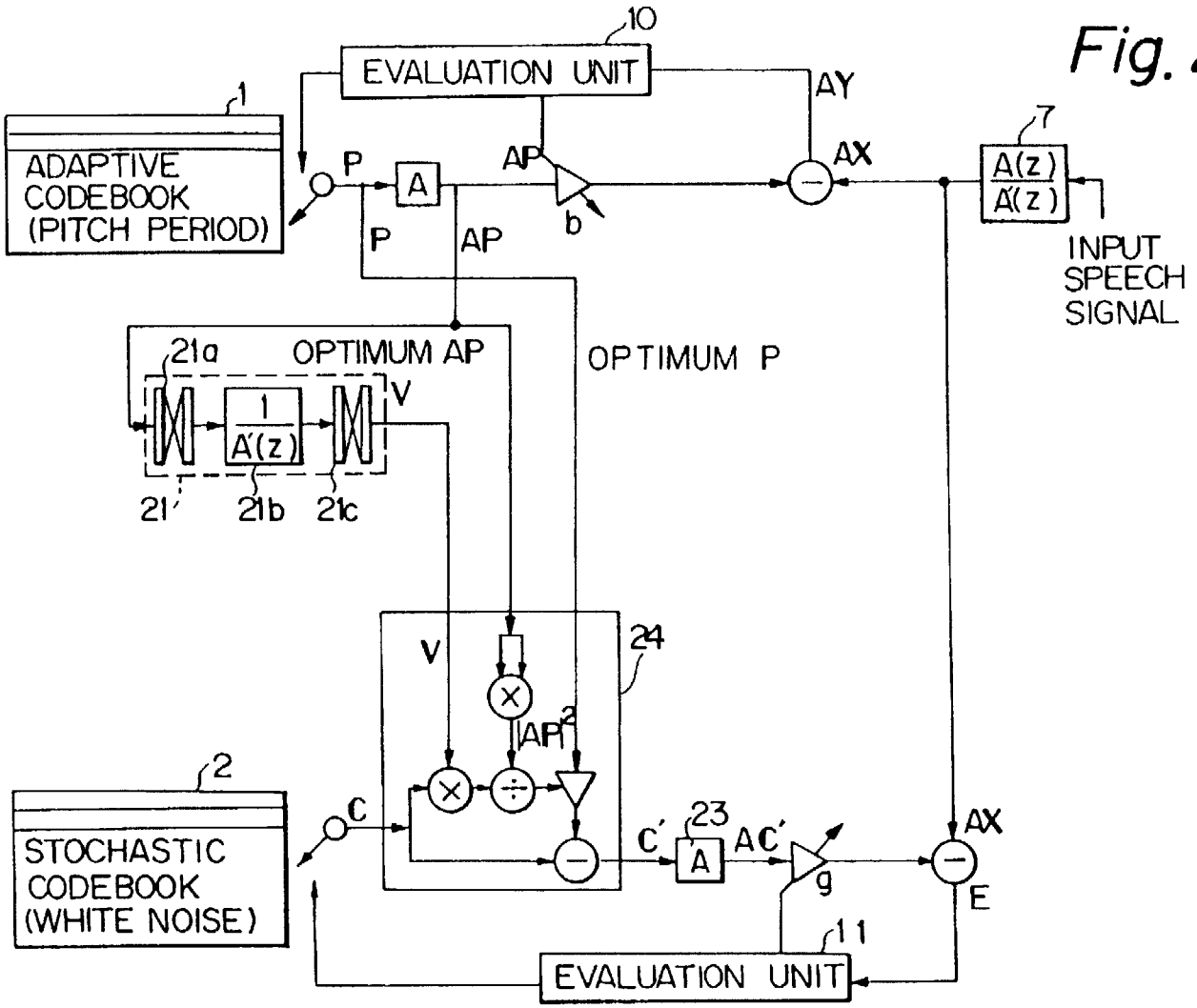
FIG. 20 is a block diagram showing a fourth embodiment of the coding system shown in FIG. 10.

FIG. 20 is a block diagram showing a fourth embodiment of the coding system shown in FIG. 10 in which FIG. 10 is a more detailed diagram than FIG. 9. The orthogonalization transformer 24 of this example achieves the calculation expressed as follows $$ \begin{aligned} C' &= C - P\{{}^tCV/{}^t(AP)AP\} \qquad (7) \\ &= C - P\{{}^tC({}^tAAP)/{}^t(AP)AP\} \\ &= C - P\{{}^t(AP)AC/{}^t(AP)AP\} \end{aligned} $$

If the vector $V={}^tAAP$ is substituted in the above equation, the equation becomes the above-recited equation (6), and thus an identical Gram-Schmidt orthogonalization transform can be realized. In this case, however, it is possible to find the vector AC', orthogonal to the vector AP, on the same plane as that on which the vector AC is defined. Therefore, it is not necessary to newly design a coder for the gain g, since the gain g becomes the same as the gain g found under the sequential optimization CELP coding method.

Figure 21:
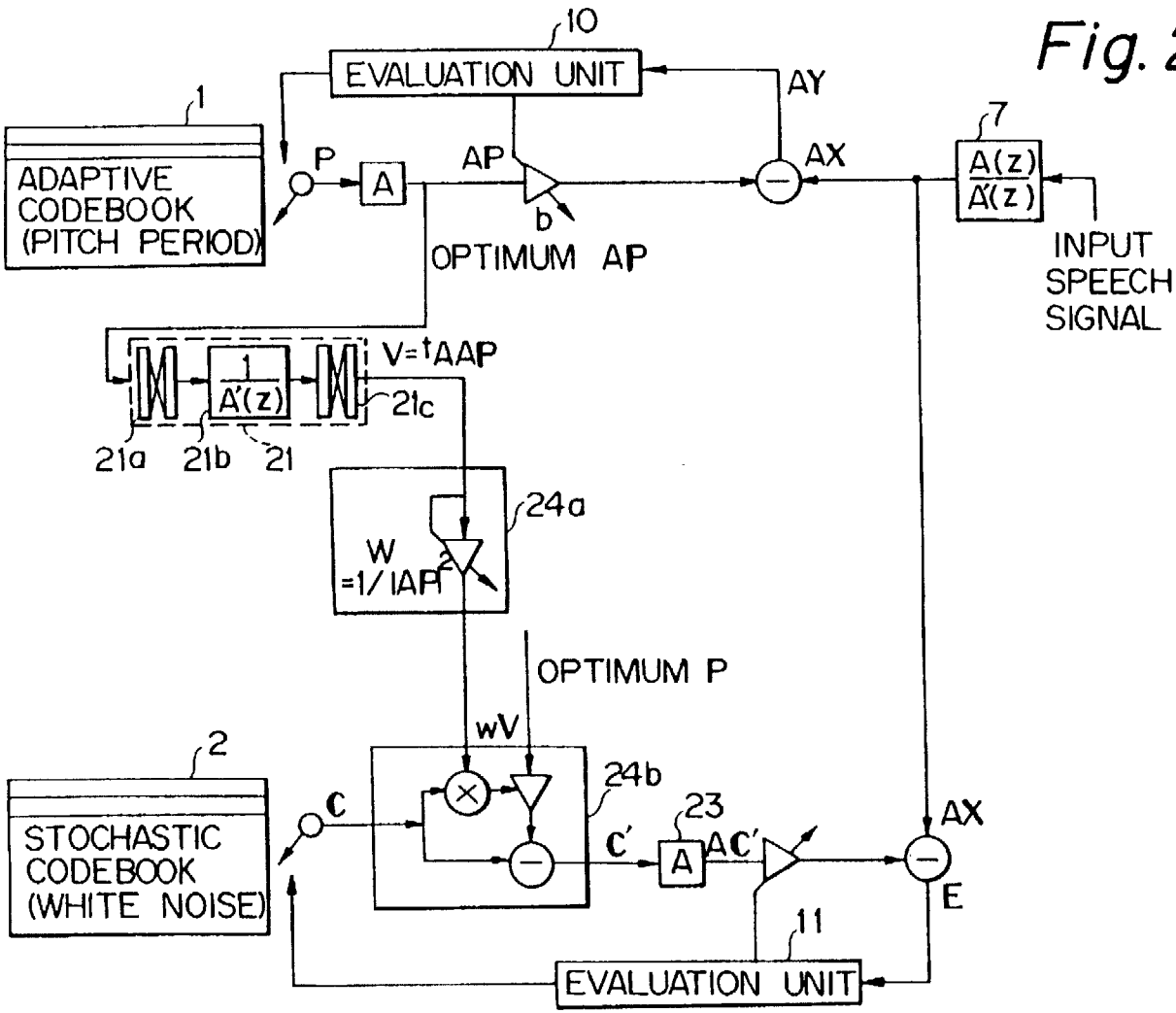
FIG. 21 is a block diagram showing a fifth embodiment modifying the fourth embodiment shown in FIG. 20.

FIG. 21 is a block diagram showing a fifth embodiment modifying the fourth embodiment shown in FIG. 20. An arithmetic processor 24*a* generates a vector wV by multiplying the arithmetic sub-vector V with the vector w ($w=1/|AP|^2$). An arithmetic processor 24*b* carries out the operation of the above-recited equation (7) by using the above vectors wV and the optimum pitch prediction residual vector P, so that the processor 24*b* generates the vector C' which will satisfy, after being perceptually weighted by A, the relationship AP being perpendicular to AC'.

Figure 22:
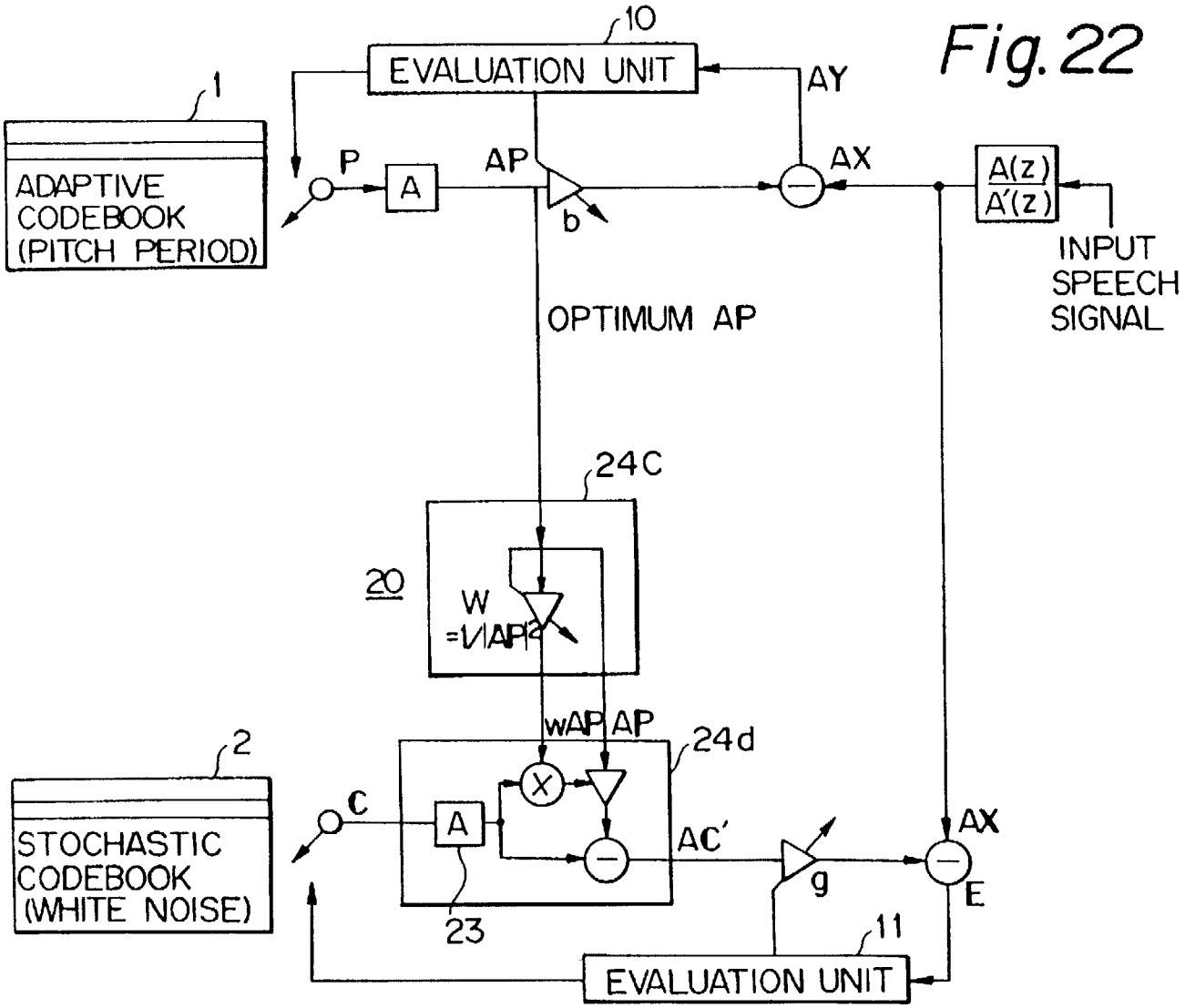
FIG. 22 is a block diagram showing a sixth embodiment modifying the structure shown in FIG. 10.

FIG. 22 is a block diagram showing a sixth embodiment modifying the structure shown in FIG. 10. In the sixth embodiment, an arithmetic processor 24*c* produces both vectors wAP and AP by directly applying thereto the optimum perceptually weighted pitch prediction residual vector AP without employing the aforesaid arithmetic processing means 21. An arithmetic processor 24*d* produces, using the above mentioned vectors (wAP, AP), the code vector AC' from the code vector C, which is perceptually weighted and orthogonal to the vector AP. The arithmetic equation used in this example is substantially the same as that used in the case of FIG. 19.

Figure 23:
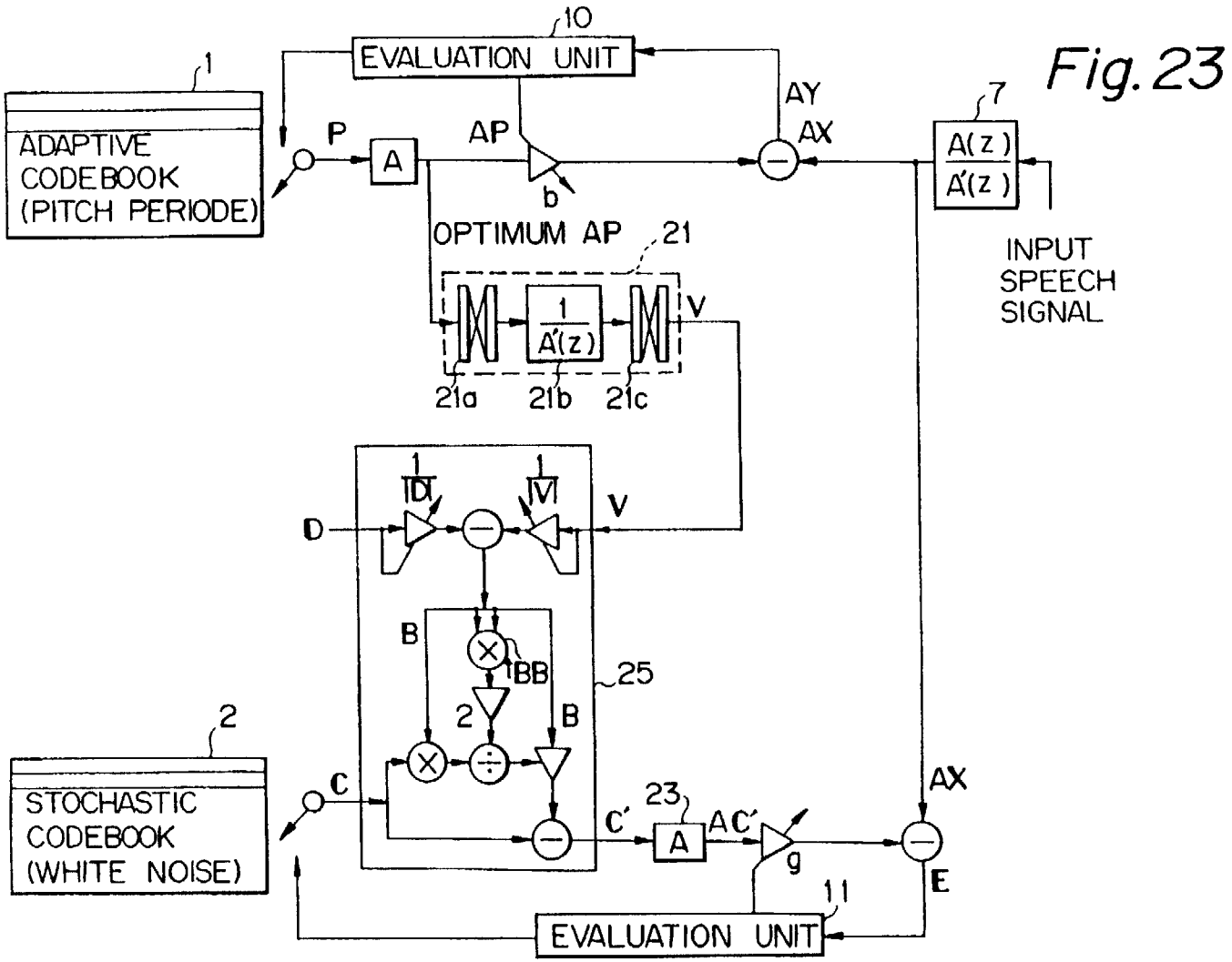
FIG. 23 is a block diagram showing a seventh embodiment of the structure shown in FIG. 11.

FIG. 23 is a block diagram showing a seventh embodiment of the structure shown in FIG. 11 which is a diagram which is more detailed than FIG. 9. The seventh embodiment of FIG. 23 is substantially identical to the embodiments or examples mentioned heretofore, except only for the addition of a orthogonalization transformer 25. The transforming equation performed by the transformer 25 is indicated as follows.

$$ C'=C-2B\{({}^tBC)/({}^tBB)\} $$

The above equation is able to realize the householder transform. In the equation (8), the vector B is expressed as follows.

$$ B=V-V\,D $$

where the vector D is orthogonal to all of the code vectors C of the stochastic codebook 2.

Referring again to FIGS. 17B and 17C, the algorithm of the householder transform will be explained below. First, the arithmetic sub-vector V is folded, with respect to a folding line, to become the parallel component of the vector D, and thus a vector (V/D)D is obtained. Here, D/D represents a unit vector of the direction D.

The thus-created D direction vector is used to create another vector in a reverse direction to the D direction, i.e., -D direction, which vector is expressed as $$ -(V/D)D $$

as shown in FIG. 17B. This vector is then added to the vector V to obtain a vector B, i.e., $$ B=V-(V/D)D $$

which becomes orthogonal to the folding line (refer to FIG. 17B).

Further, a component of the vector C projected onto the vector B is found as follows, as shown in FIG. 17C.

$$\{({}^tCB)/({}^tBB)\}B$$

The thus-found vector is doubled in an opposite direction, i.e., $$-\frac{2\,{}^tCB}{{}^tBB}\,B,$$

and added to the vector C, and as a result the vector C' is obtained, which is orthogonal to the vector V.

Thus, the vector C' is created and is applied with the perceptual weighting A to obtain the code vector AC', which is orthogonal to the optimum vector AP.

Figure 24:
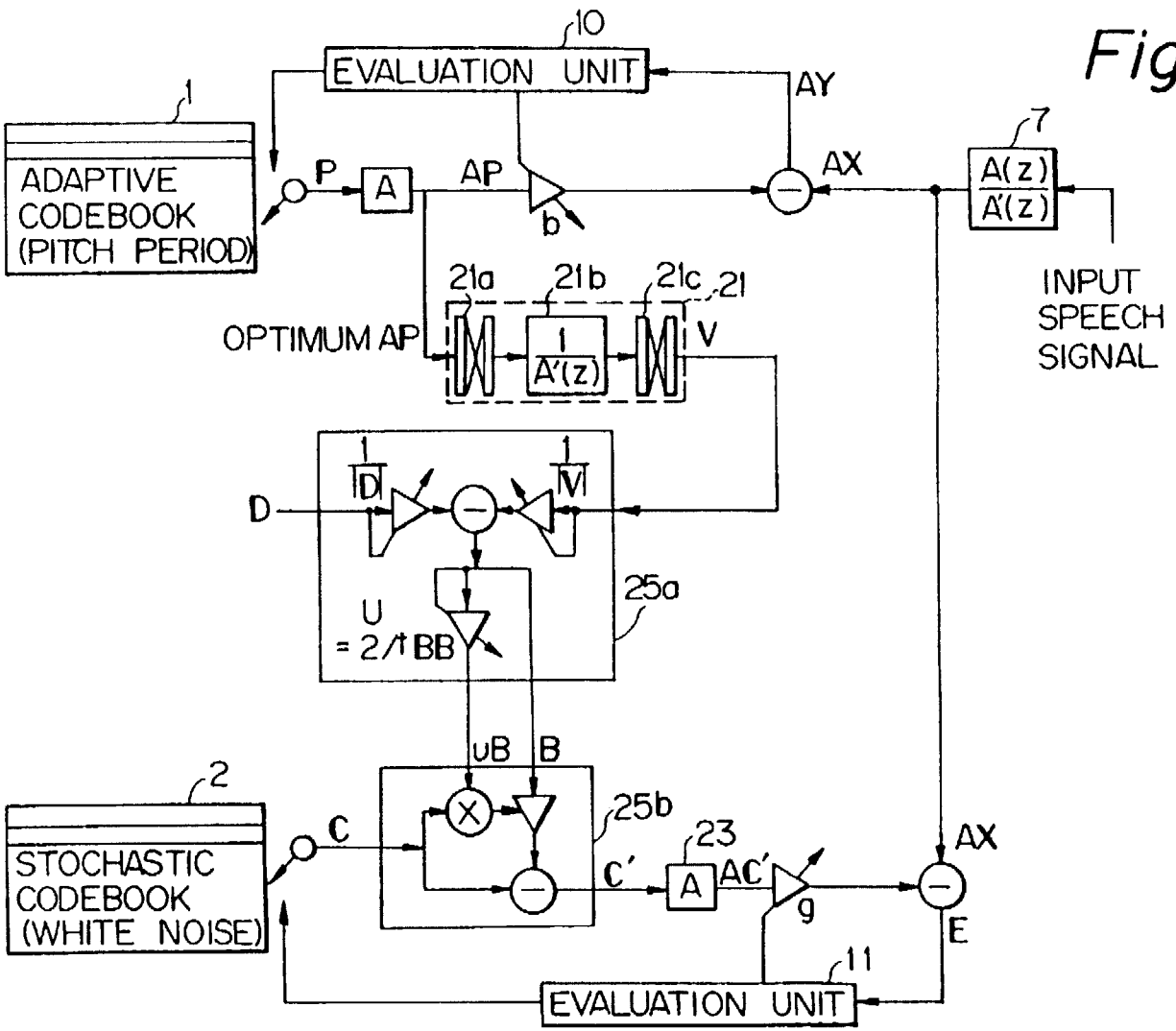
FIG. 24 is a block diagram showing an eighth embodiment modifying the seventh embodiment shown in FIG. 23.

FIG. 24 is a block diagram showing an eighth embodiment modifying the seventh embodiment shown in FIG. 23. Namely, the orthogonalization transformer 25 of FIG. 23 is divided into a arithmetic processor 25*a* and an arithmetic processor 25*b*. The arithmetic processor 25*a* produces two vectors uB (u=2/${}^t$BB) and B by using the input vector V and the vector D. The arithmetic processor 25*b* produces the vector C', by using the above vectors, and vector C, which vector C' is orthogonal to the vector V.

The above embodiment of FIG. 24 produces an advantage in that the computation amount at the arithmetic processor 25B can be reduced, as in the embodiment of FIG. 21.

Figure 25:
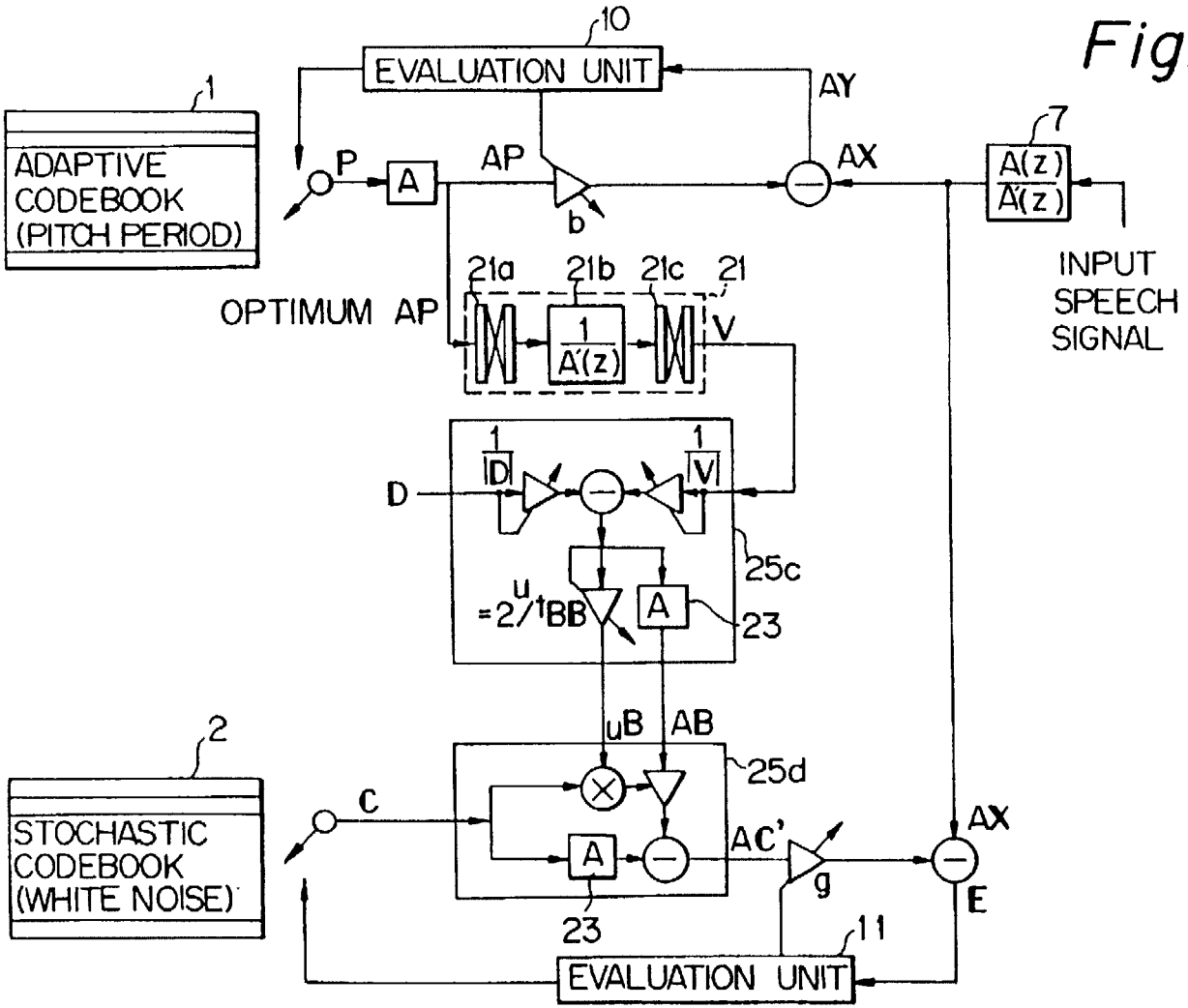
FIG. 25 is a block diagram showing a ninth embodiment modifying the seventh embodiment shown in FIG. 23.

FIG. 25 is a block diagram showing a ninth embodiment modifying the seventh embodiment shown in FIG. 23.

In this embodiment, a perceptual weighting matrix A is included in arithmetic processor 25*c* and arithmetic processor 25*d*. The arithmetic processor 25*c* produces two vectors uB and AB, based on the input vector V an the vector D. The arithmetic processor 25*d* receives the above vectors (uB, AB) and transform to generate, from the vector C, the vector AC', which is orthogonal to the vector AP. Note that the arithmetic structure of this embodiment is basically identical to the arithmetic structure used under the Gram-Schmidt orthogonalization transform shown in FIG. 19.

Figure 26:
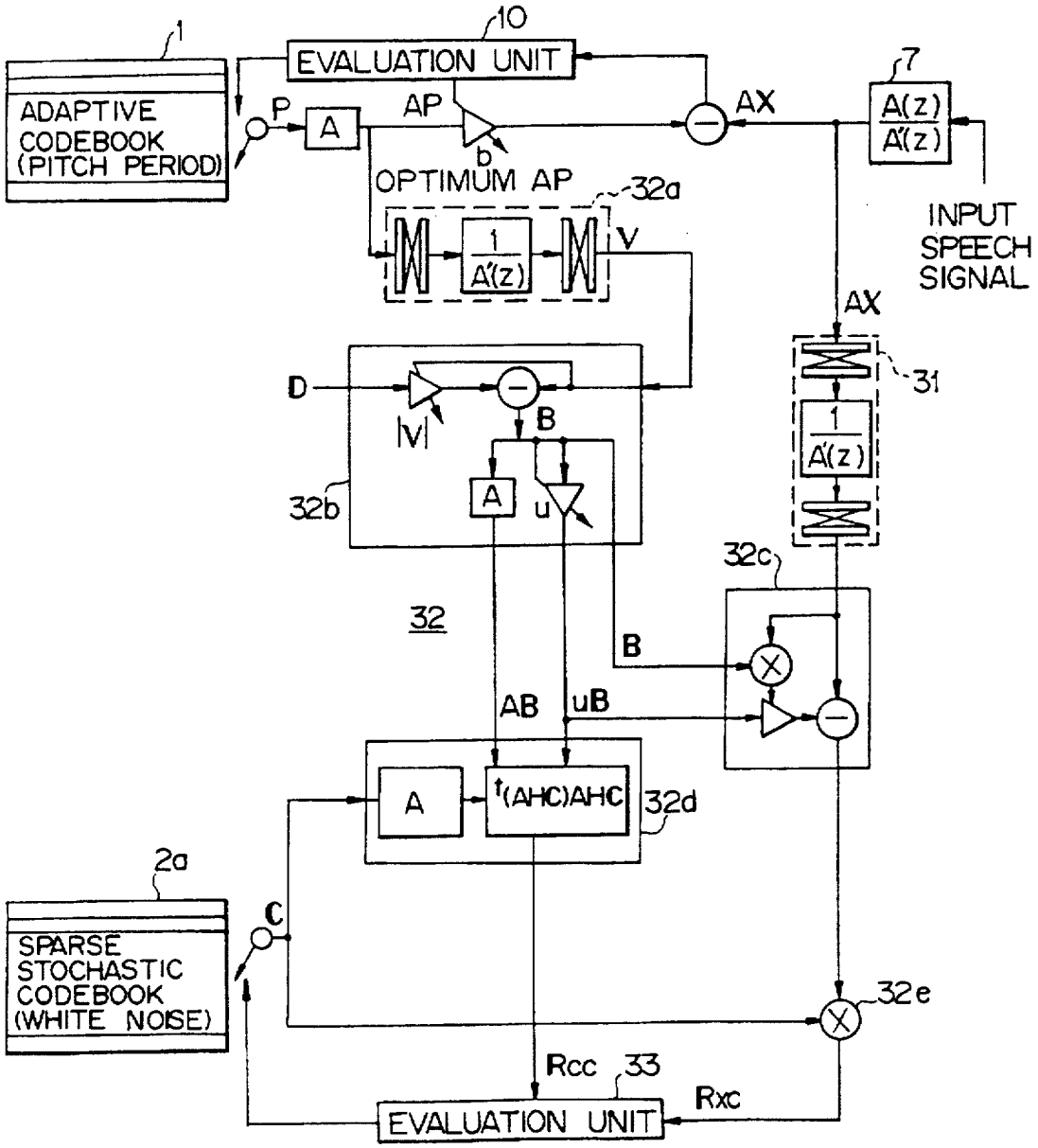
FIG. 26 is a block diagram showing a tenth embodiment of the structure shown in FIG. 12.

FIG. 26 is a block diagram showing a tenth embodiment modifying the structure shown in FIG. 12 which is the same as the invention in FIG. 6 using a sparse-stochastic codebook. The arithmetic processing means 31 of FIG. 12 can be comprised of the transpose matrix ${}^t$A, as in the aforesaid arithmetic processing means 21 in FIG. 15, but in the embodiment of FIG. 26, the arithmetic processing means 31 is comprised of the backward type filter which achieves an inverse operation in time.

Further, an orthogonalization transformer 32 is comprised of arithmetic processors 32*a*, 32*b*, 32*c*, 32*d* and 32*e*. The arithmetic processor 32*a* generates, as in the arithmetic processing means 31, the arithmetic sub-vector V (=${}^t$AAP) by applying a backward perceptual weighting to the optimum pitch prediction residual vector AP provided as an input signal thereto.

The above vector V is transformed, by the arithmetic processor 32*b* including the perceptual weighting matrix A, into three vectors B, uB and AB by using the vector D which is orthogonal to all the code vectors of the sparse-stochastic codebook 2*a*.

The arithmetic processor 32*c* applies the backward householder orthogonalization transform to the vector ${}^t$AAX from the arithmetic processing means 31 to generate ${}^t$H${}^t$AAX (=${}^t$(AH)AX).

The time-reversing householder transform, ${}^t$H, of the arithmetic processor 32*c* will be explained below.

First, the above-recited equation (8) is rewritten, by using u=2/${}^t$BB, as follows $$C'=C-B(u^tBC)$$

The equation (9) is transformed, by using C'=HC, as follows $$\begin{aligned} H &= C'C^{-1} \\ &= I-B(u^tB) \quad (I \text{ is a unit vector}) \end{aligned}$$

Accordingly, $$\begin{aligned} {}^tH &= I-(uB)^tB \\ &= I-B(u^tB) \end{aligned}$$

is obtained, which is the same as H written above.

Here, the aforesaid vector ${}^t$(AH)AX input to the arithmetic processor 32*c* is replaced by, e.g., W, and the following equation stands.

$${}^tHW=W-(WB)(u^tB)$$

This is realized by the arithmetic construction as shown in the figure.

The above vector ${}^t$(AH)AX is multiplied, at a multiplier 32*e*, with the sparse code vector C from the codebook 2*a*, to obtain a correlation value $R_{XC}$ which is expressed as below.

$$\begin{aligned} R_{XC} &= {}^tC^t(AH)AX \\ &= {}^t(AHC)AX \end{aligned}$$

The value $R_{XC}$ is sent to an evaluation unit 33.

The arithmetic processor 32*d* receives the input vectors AB, uB, and the sparse-code vector C, and further, uses the internal perceptual weighting matrix A to find a vector (AHC), i.e., $$AHC=AC-{}^tC(AB)(u^tB)$$

The vector AHC is orthogonal to the optimum pitch prediction residual vector AP.

Further an autocorrelation value $R_{cc}$ of the above vector AHC, i.e., $$R_{CC}={}^t(AHC)AHC$$

is generated and is sent to the evaluation unit 33.

When HC=C' is substituted for the aforesaid two correlation values ($R_{XC}$, $R_{CC}$) to be sent to the evaluation unit 33, the arithmetic construction becomes identical to that of FIG. 4, and therefore, the evaluation unit 33 can select the optimum code vector and gain.

Although the tenth embodiment of FIG. 26 is illustrated based on the householder transform, it is also possible to construct the same embodiment based on the Gram-Schmidt transform.

As explained above in detail, the present invention provides a CELP coding and decoding system based on a new concept. The CELP coding of the present invention is basically similar to the simultaneous optimization CELP coding, rather than the sequential optimization CELP coding, but the CELP coding of the present invention is more convenient than the simultaneous optimization CELP coding due to an independence of the gain at the adaptive codebook side from the gain at the stochastic codebook side.

We claim:

1. A speech coding and decoding system comprising:

an adaptive codebook storing therein a plurality of pitch prediction residual vectors;

a first evaluation unit, operatively connected to said adaptive codebook, to select from said adaptive codebook one of the pitch prediction residual vectors and a first gain corresponding thereto, to minimize a first power of a pitch prediction error signal vector representing an error between the perceptually weighted input speech signal vector and a pitch prediction reproduced signal obtained by multiplying the first gain times a perceptually weighted pitch prediction residual vector formed by perceptually weighting the one of the pitch prediction residual vectors by a first perceptual weighting matrix;

arithmetic processing means for receiving the perceptually weighted input speech signal vector and for applying a perceptual weighting to the perceptually weighted input speech signal vector to calculate a perceptually weighted input speech signal vector;

a sparse-stochastic codebook storing therein thinned out code vectors representing white noise;

an orthogonalization transformer, operatively connected to said sparse-stochastic codebook and to receive the perceptually weighted pitch prediction residual vector, each of the thinned out code vectors and the perceptually weighted input speech signal vector from said arithmetic processing means, to perceptually weight and orthogonally transform the perceptually weighted pitch prediction residual vector into a resultant input speech signal vector and to find an autocorrelation value of an orthogonal vector orthogonal to the one of the pitch prediction residual vectors;

correlation means for finding a correlation value using the resultant input speech signal vector generated by said orthogonalization transformer and each of the thinned out code vectors; and a second evaluation unit, operatively connected to said correlation means and to receive the perceptually weighted input speech signal, to select at least one of the thinned out code vectors and a second gain corresponding thereto, to minimize a second power of an error signal vector between the perceptually weighted input speech signal vector and the orthogonal vector, using the autocorrelation value and the correlation value to encode the perceptually weighted input speech signal vector as the one of the pitch prediction residual vectors, the code vector and the first and second gains corresponding thereto.

2. A speech coding and decoding system according to claim 1, wherein said arithmetic processing means uses a transpose matrix.

3. A speech coding and decoding system according to claim 1, wherein said arithmetic processing means comprises a backward type filter which achieves an inverse operation in time.

4. A speech coding and decoding system according to claim 1, wherein said orthogonalization transformer comprises first to fifth arithmetic processors, said first arithmetic processor generating an arithmetic sub-vector by applying a backward perceptual weighting to the one of the pitch prediction residual vectors received as an input signal from said first evaluation unit, said second arithmetic processor, including the perceptual weighting matrix, transforming the arithmetic subvector into transformed vectors by using a calculation vector which is orthogonal to all of the thinned out code vectors of said sparse-stochastic codebook, said third arithmetic processor being supplied with some of the transformed sub-vectors and applying a backward Householder orthogonalization transform to the perceptually weighted input speech signal vector from said arithmetic processing means to generate the input speech signal vector;

said fourth arithmetic processor receiving some of the transformed sub-vectors as input vectors and the thinned out code vectors, using an internal perceptual weighting matrix to find the orthogonal vector, and generating the autocorrelation value of the orthogonal vector for sending to said second evaluation unit; and said fifth arithmetic processor comprises finding a correlation value between the input speech signal vector and each of the thinned out code vectors for sending to said second evaluation unit.

5. A speech coding and decoding system according to claim 2, wherein said orthogonalization transformer comprises a Gram-Schmidt orthogonalization transformer.

* * * * *

UNITED STATES PATENT AND TRADEMARK OFFICE

CERTIFICATE OF CORRECTION

PATENT NO.: 5,799,131
DATED : August 25, 1998
INVENTOR(S): Tomohiko TANIGUCHI et al.

It is certified that error appears in the above-identified patent and that said Letters Patent is hereby corrected as shown below:

Col. 5, line 65, in the equation, delete "V".

Col. 10, line 12, change "A(AP)TR" to --$A(AP)_{TR}$--.

Signed and Sealed this

Thirtieth Day of November, 1999

*Attest:*

*Attesting Officer*

Q. TODD DICKINSON

*Acting Commissioner of Patents and Trademarks*